US006277554B1

(12) United States Patent
Yamada et al.

(10) Patent No.: US 6,277,554 B1
(45) **Date of Patent: *Aug. 21, 2001**

(54) THERMOGRAPHIC RECORDING ELEMENT

(75) Inventors: Kohzaburoh Yamada; Hiroyuki Suzuki; Toshihide Ezoe, all of Kanagawa (JP)

(73) Assignee: Fuji Photo Film, Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/309,305

(22) Filed: May 11, 1999

(30) Foreign Application Priority Data

May 11, 1998 (JP) ..... 10-145055

(51) Int. Cl.[7] ..... G03C 1/498

(52) U.S. Cl. ..... 430/619; 430/264; 430/607; 430/613; 430/614; 430/615

(58) Field of Search ..... 430/619, 617, 430/264, 607, 613, 614, 615

(56) References Cited

U.S. PATENT DOCUMENTS

| | | |
|---|---|---|
| 5,496,695 | 3/1996 | Simpson et al. . |
| 5,545,515 | 8/1996 | Murray et al. . |

FOREIGN PATENT DOCUMENTS

| | | |
|---|---|---|
| 0713131 | 5/1996 | (EP) . |
| 0762196A1 | 3/1997 | (EP) . |
| 0803764 | 10/1997 | (EP) . |
| 0897130A1 | 2/1999 | (EP) . |
| 0921433 | 6/1999 | (EP) . |

*Primary Examiner*—Thorl Chea
(74) *Attorney, Agent, or Firm*—Birch, Stewart, Kolasch & Birch, LLP

(57) ABSTRACT

In a thermographic recording element comprising an organic silver salt, a photosensitive silver halide, and a reducing agent, there are further included a specific compound and a hydrazine derivative. The element exhibits a high contrast and the minimized dependency of photographic properties on developing temperature.

19 Claims, 1 Drawing Sheet

THERMOGRAPHIC RECORDING ELEMENT

This invention relates to a thermographic recording element, and more particularly, to a photothermographic element suitable for use in a photomechanical process.

BACKGROUND OF THE INVENTION

Photothermographic elements for forming photographic images through heat development are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic elements generally contain a reducible silver source (e.g., organic silver salt), a catalytic amount of a photocatalyst (e.g., silver halide), a toner for controlling the silver tone, and a reducing agent, typically dispersed in a binder matrix. Photothermographic elements are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

Such photothermographic materials have been used as microphotographic and medical photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has a high enough sensitivity and Dmax that it may comply with such output devices.

From the contemporary standpoints of environmental protection and space saving, it is strongly desired in the graphic printing field to reduce the quantity of spent solution. Needed in this regard is a technology relating to photothermographic materials for use in the graphic printing field which can be effectively exposed by means of laser image setters and produce clear black images having a high resolution and sharpness. These photothermographic materials offer to the customer a simple thermographic system which eliminates a need for solution type chemical agents and is not detrimental to the environment.

U.S. Pat. No. 3,667,958 discloses that a photothermographic element comprising a polyhydroxybenzene combined with a hydroxylamine, reductone or hydrazine has high image quality discrimination and resolution. This combination of reducing agents, however, was found to incur an increase of fog.

For producing a thermographic recording element having high Dmax and high contrast, it is effective to add to the element the hydrazine derivatives described in U.S. Pat. No. 5,496,695. Although this results in a thermographic recording element having high Dmax and high contrast, all of sensitivity, contrast, Dmax, Dmin, and storage stability of compounds are not fully satisfied.

Improvements in contrast and storage stability of compounds are achieved by using the hydrazine derivatives described in EP 762196A1, but the fully satisfactory level has not been reached.

Further, U.S. Pat. Nos. 5,545,515 and 5,635,339 disclose the use of acrylonitriles as the co-developer. With these acrylonitrile compounds, a fully satisfactory high contrast is not achieved, fog rises, and the photographic properties largely depend on the developing time.

SUMMARY OF THE INVENTION

Therefore, an object of the invention is to provide a—thermographic recording element featuring an ultrahigh contrast and especially a photomechanical recording element exhibiting excellent photographic properties, for example, maximum density (Dmax) and fog, which are least dependent on developing temperature and processable on a fully dry basis without a need for wet processing.

According to the invention, there is provided a thermographic recording element having at least one image forming layer and comprising an organic silver salt, a photosensitive silver halide, a reducing agent, a hydrazine derivative, and at least one compound selected from compounds of the following formulas (A) and (B).

formula (A)

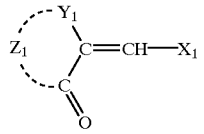

In formula (A), $Z_1$ is a group of non-metallic atoms completing a 5- to 7-membered cyclic structure, $Y_1$ is —C(=O)— or —$SO_2$— and $X_1$ is a hydroxyl group or salt thereof, alkoxy group, aryloxy group, heterocyclic oxy group, mercapto group or salt thereof, alkylthio group, arylthio group, heterocyclic thio group, acylamino group, sulfonamide group or heterocyclic group, the compound of formula (A) having at least 6 carbon atoms in total.

formula (B)

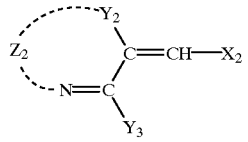

In formula (B), $Z_2$ is a group of non-metallic atoms completing a 5- to 7-membered cyclic structure, $Y_2$ is —C(=O)— or —$SO_2$—, $X_2$ is a hydroxyl group or salt thereof, alkoxy group, aryloxy group, heterocyclic oxy group, mercapto group or salt thereof, alkylthio group, arylthio group, heterocyclic thio group, acylamino group, sulfonamide group or heterocyclic group, and $Y_3$ is hydrogen or a substituent, the compound of formula (B) having at least 12 carbon atoms in total.

In formula (A), $Z_1$ preferably has at least 3 carbon atoms in total. $Y_1$ is preferably a carbonyl group and $Z_1$ is a group of atoms capable of forming a 5- or 6-membered cyclic structure; more preferably, $Y_1$ is a carbonyl group and $Z_1$ forms an indanedione, pyrrolidinedione, or pyrazolidinedione ring with —$Y_1$—C(=CH—$X_1$)—C(=O)—.

Further preferably, $X_1$ represents a hydroxy group or a salt thereof, an alkoxy group, a mercapto group or a salt thereof, an alkylthio group, or a heterocyclic group; $Z_1$ represents a group of atoms capable of forming a pyrazolidinedione ring.

In formula (B), $Z_2$ and $Y_3$ preferably have at least 8 carbon atoms in total; more preferably, $Y_2$ is a carbonyl group and $Z_2$ is an oxygen or nitrogen atom capable of forming a 5-membered cyclic structure.

The hydrazine derivative is preferably of the following formula (2).

$$R^{11}—NHNH—CO—C(R^{22})(R^{33})—X \quad (2)$$

In formula (2), $R^{11}$ represents an aromatic group; $R^{22}$ and $R^{33}$ independently represent hydrogen or a substituent; X represents —OH, —OR, —OCOR, —SH, —SR, —NHCOR, —$NHSO_2R$, —$NHCON(R_N)R_N'$, —$NHSO_2N(R_N)R_N'$, —$NHCO_2R$, —$NHCOCON(R_N)R_N'$, —$NHCOCO_2R$, —$NHCON(R_N)SO_2R$ or —$N(R_N)R_N'$; R represents an alkyl, aryl or heterocyclic group; and $R_N$ and $R_N'$ independently represent hydrogen or an alkyl, aryl or heterocyclic group. Preferably, X represents —OH, —OR, —NHCOR, —$NHSO_2R$ or —$N(R_N)R_N'$.

BRIEF DESCRIPTION OF THE DRAWING

The only figure.

DETAILED DESCRIPTION OF THE INVENTION

Figure 1:
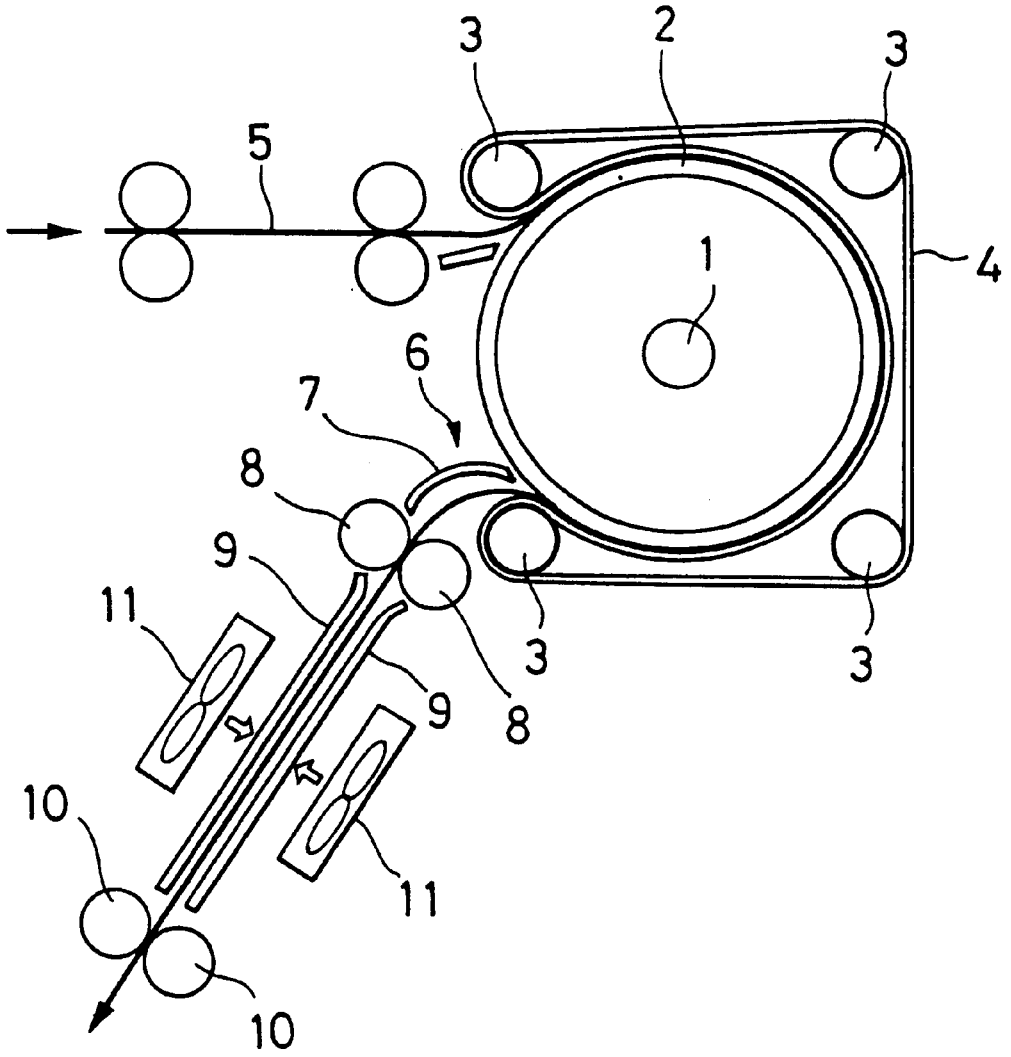
FIG. 1 is a schematic view of one exemplary heat developing apparatus for use in the processing of the photothermographic element according to the invention.

The thermographic recording element of the invention is a photothermographic (or photosensitive heat developable) element having at least one image forming layer and containing an organic silver salt, a photosensitive silver halide, and a reducing agent. In particular, it is a high-contrast photosensitive element for printing application.

By incorporating at least one of the compounds of formulas (A) and (B) and at least one hydrazine derivative in the thermographic recording element defined above, a fully satisfactory high contrast is achieved and the dependency on developing temperature of photographic characteristics such as Dmax and fog is minimized. By contrast, compounds analogous to, but different from the compounds of formulas (A) and (B), for example, acrylonitrile compounds fail to provide a good compromise between high contrast and development temperature dependency. Contrast can be enhanced by increasing the amount of such analogous compounds, but at the sacrifice of fog and development temperature dependency.

Compounds of Formulas (A) and (B)

First of all, the compounds of formulas (A) and (B) are described in detail.

In formula (A), $Z_1$ is a group of non-metallic atoms capable of forming a 5- to 7-membered cyclic structure with —$Y_1$—C(═CH—$X_1$)—C(═O)—. Preferably $Z_1$ is a group of atoms selected from among carbon, oxygen, sulfur, nitrogen and hydrogen atoms wherein several atoms in the group are coupled through valence bonds or double bonds to form a 5- to 7-membered cyclic structure with —$Y_1$—C(═CH—$X_1$)—C(═O)—. $Z_1$ may have a substituent or substituents. Also, $Z_1$ itself may be a part of an aromatic or non-aromatic carbocycle or a part of an aromatic or non-aromatic heterocycle, and in this case, the 5- to 7-membered cyclic structure that $Z_1$ forms with —$Y_1$—C(═CH—$X_1$)—C(═O)— forms a fused ring structure.

In formula (B), $Z_2$ is a group of non-metallic atoms capable of forming a 5- to 7-membered cyclic structure with —$Y_2$—C(═CH—$X_2$)—C($Y_3$)═N—. Preferably $Z_2$ is a group of atoms selected from among carbon, oxygen, sulfur, nitrogen and hydrogen atoms wherein several atoms in the group are coupled through valence bonds or double bonds to form a 5- to 7-membered cyclic structure with —$Y_2$—C(═CH—$X_2$)—C($Y_3$)═N—. $Z_2$ may have a substituent or substituents. Also, $Z_2$ itself may be a part of an aromatic or non-aromatic carbocycle or a part of an aromatic or non-aromatic heterocycle, and in this case, the 5- to 7-membered cyclic structure that $Z_2$ forms with —$Y_2$—C(═CH—$X_2$)—C($Y_3$)═N— forms a fused ring structure.

When $Z_1$ and $Z_2$ have substituents, exemplary substituents include halogen atoms (e.g., fluorine, chlorine, bromine and iodine), alkyl groups (including aralkyl, cycloalkyl, and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazido groups, thiosemicarbazido groups, hydrazino groups, quaternary ammonio groups, oxamoylamino groups, (alkyl or aryl) sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, groups containing a phosphoramide or phosphate structure, silyl groups, and stannyl groups. These substituents may be further substituted with such substituents.

In formula (B), $Y_3$ is hydrogen or a substituent. Illustrative substituents represented by $Y_3$ include alkyl, aryl, heterocyclic, cyano, acyl, alkoxycarbonyl, aryloxycarbonyl, carbamoyl, amino, (alkyl, aryl or heterocyclic) amino, acylamino, sulfonamide, ureido, thioureido, imide, alkoxy, aryloxy, and (alkyl, aryl or heterocyclic) thio groups. These groups represented by $Y_3$ may have any substituents, examples of which are the above-exemplified substituents that $Z_1$ or $Z_2$ may have.

In formulas (A) and (B), $X_1$ and $X_2$ represent hydroxyl groups or salts thereof, alkoxy groups (e.g., methoxy, ethoxy, propoxy, isopropoxy, octyloxy, decyloxy, dodecyloxy, cetyloxy, butoxy, and t-butoxy), aryloxy groups (e.g., phenoxy and p-t-octylphenoxy), heterocyclic oxy groups (e.g., benztriazolyl-5-oxy and pyridinyl-3-oxy), mercapto groups or salts thereof, alkylthio groups (e.g., methylthio, ethylthio, butylthio and dodecylthio), arylthio groups (e.g., phenylthio and p-dodecylphenylthio), heterocyclic thio groups (e.g., 1-phenyltetrazoyl-5-thio and mercaptothiadiazolylthio), acylamino groups (e.g., acetamido, octanoylamino, benzoylamino and trifluoroacetylamino), sulfonamide groups (e.g., methanesulfonamide, benzenesulfonamide and dodecylsulfonamide) or nitrogenous heterocyclic groups. These groups may have substituents thereon.

The last-mentioned nitrogenous heterocyclic groups are nitrogenous heterocyclic groups separated by a nitrogen atom and encompass aromatic or non-aromatic, saturated or unsaturated, monocyclic or fused ring, substituted or unsubstituted nitrogenous heterocyclic groups. Exemplary are N-methylhydantoyl, N-phenylhydantoyl, succinimide, phthalimide, N,N'-dimethylurazolyl, imidazolyl, benztriazolyl, indazolyl, morpholino, and 4,4-dimethyl-2,5-dioxo-oxazolyl groups.

The salts include salts of alkali metals (e.g., sodium, potassium and lithium), salts of alkaline earth metals (e.g., magnesium and calcium), salts of silver, quaternary ammonium salts (e.g., tetraethylammonium and dimethylcetylbenzylammonium salts), and quaternary phosphonium salts.

In formulas (A) and (B), $Y_1$ and $Y_2$ each are —C(=O)— or —$SO_2$—.

The compounds of formula (A) each have at least 6 carbon atoms in total, and the compounds of formula (B) each have at least 12 carbon atoms in total. of the compounds of formulas (A) and (B), the following compounds are preferred.

In formulas (A) and (B), $Y_1$ and $Y_2$ each are preferably —C(=O)—.

In formulas (A) and (B), each of $X_1$ and $X_2$ is preferably a hydroxyl group or salt thereof, alkoxy group, heterocyclic oxy group, acylamino group, mercapto group or salt thereof, alkylthio group, arylthio group, heterocyclic thio group, sulfonamide group or heterocyclic group. More preferably, each of $X_1$ and $X_2$ is a hydroxyl group or salt thereof, alkoxy group, mercapto group or salt thereof, alkylthio group, or heterocyclic group, further preferably a hydroxyl group or salt thereof, alkoxy group, or heterocyclic group, and most preferably a hydroxyl group or salt thereof or alkoxy group.

In formula (A) or (B), when $X_1$ or $X_2$ represents an alkoxy group, the total number of carbon atoms in that group is preferably 1 to 18, more preferably 1 to 12, and most preferably 1 to 5. Also in formula (A) or (B), when $X_1$ or $X_2$ represents a heterocyclic group, the total number of carbon atoms in that group is preferably 2 to 20, more preferably 2 to 16.

In formula (A), $Z_1$ is preferably a group of atoms capable of forming a 5- or 6-membered cyclic structure. Illustratively, $Z_1$ is a group of atoms selected from among nitrogen, carbon, sulfur and oxygen atoms, for example, —N—N—, —N—C—, —O—C—, —C—C—, —C=C—, —S—C—, —C=C—N—, —C=C—O—, —N—C—N—, —N=C—N—, —C—C—C—, —C=C—C—, and —O—C—O—, which further have hydrogen atoms or substituents. More preferably, $Z_1$ is a group of atoms such as —N—N—, —N—C—, —O—C—, —C—C—, —C=C—, —S—C—, —N—C—N—, or —C=C—N—, which further have hydrogen atoms or substituents. Most preferably, $Z_1$ is a group of atoms such as —N—N—, —N—C—, or —C=C—, which further have hydrogen atoms or substituents.

Also preferably, $Z_1$ itself is a part of an aromatic or non-aromatic carbocycle or an aromatic or non-aromatic heterocycle, and forms a fused ring structure to the 5- to 7-membered cyclic structure that $Z_1$ forms with —$Y_1$—C(=CH—$X_1$)—C(=O)—. Examples of the aromatic or non-aromatic carbocycles or the aromatic or non-aromatic heterocycle include benzene, naphthalene, pyridine, cyclohexane, piperidine, pyrazolidine, pyrrolidine, 1,2-piperazine, 1,4-piperazine, oxan, oxolane, thian, and thiolane rings. These carbocycles and heterocycles may further have a cyclic ketone fused thereto. Of the carbocycles and heterocycles, benzene, piperidine, and 1,2-piperazine rings are preferred, with the benzene ring being most preferred.

In formula (B), $Z_2$ is preferably a group of atoms capable of forming a 5- or 6-membered cyclic structure. Illustratively, $Z_2$ is a group of atoms selected from among nitrogen, carbon, sulfur and oxygen atoms, for example, —N—, —O—, —S—, —C—, —C=C—, —C—C—, —N—C—, —N=C—, —O—C—, and —S—C—, which further have hydrogen atoms or substituents if possible.

Also preferably, $Z_2$ itself is a part of an aromatic or non-aromatic carbocycle or an aromatic or non-aromatic heterocycle, and forms a fused ring structure to the 5- to 7-membered cyclic structure that $Z_2$ forms with —$Y_2$—C(=CH—$X_2$)—C($Y_3$)=N—. Examples of the aromatic or non-aromatic carbocycle or the aromatic or non-aromatic heterocycle include benzene, naphthalene, pyridine, cyclohexane, piperidine, pyrazolidine, pyrrolidine, 1,2-piperazine, 1,4-piperazine, oxan, oxolane, thian, and thiolane rings.

More preferably in formula (B), $Z_2$ is such a group of atoms as —N—, —O—, —S—, —C—, or —C=C—, which further have hydrogen atoms or substituents if possible, and especially such a group of atoms as —N— or —O—, which further have hydrogen atoms or substituents if possible.

In formulas (A) and (B), preferable substituents that $Z_1$ or $Z_2$ have include alkyl, aryl, halogen, heterocyclic, acyl, alkoxycarbonyl, aryloxycarbonyl, carbamoyl, carboxy (or salt thereof), sulfonylcarbamoyl, cyano, hydroxy, acyloxy, alkoxy, amino, (alkyl, aryl or heterocyclic) amino, acylamino, sulfonamide, ureido, thioureido, imide, (alkoxy or aryloxy) carbonylamino, sulfamoylamino, nitro, mercapto, (alkyl, aryl or heterocyclic) thio, (alkyl or aryl) sulfonyl, sulfo (or salt thereof), and sulfamoyl groups.

Where $Z_1$ or $Z_2$ itself becomes a part of an aromatic or non-aromatic carbocycle or an aromatic or non-aromatic heterocycle to form a fused ring structure, the aromatic or non-aromatic carbocycle or aromatic or non-aromatic heterocycle may have a substituent or substituents, which are preferably selected from the same groups as described just above.

$Y_3$ in formula (B) is preferably hydrogen or one of the following substituents: alkyl, aryl (especially phenyl and naphthyl), heterocyclic, cyano, acyl, alkoxycarbonyl, carbamoyl, (alkyl, aryl or heterocyclic) amino, acylamino, sulfonamide, ureido, imide, alkoxy, aryloxy, and (alkyl, aryl or heterocyclic) thio groups.

More preferably, $Y_3$ in formula (B) is a substituent. Illustrative substituents are alkyl, phenyl, amino, anilino, acylamino, alkoxy, aryloxy, and carbamoyl groups. These substituents may further have substituents although the total number of carbon atoms is preferably 1 to 25, more preferably 1 to 18.

The compounds of formula (A) have at least 6 carbon atoms in total, and the compounds of formula (B) have at least 12 carbon atoms in total. No upper limit is imposed on the total number of carbon atoms although the total number of carbon atoms in the compounds of formula (A) is preferably up to 40, more preferably up to 30, and the total number of carbon atoms in the compounds of formula (B) is preferably up to 40, more preferably up to 32.

In formula (A), the total number of carbon atoms included in $Z_1$, inclusive of its substituents, is preferably at least 2, more preferably at least 3. In formula (B), the total number of carbon atoms included in $Z_2$ and $Y_3$, inclusive of their substituents, is preferably at least 8. In formula (A), the total number of carbon atoms included in $Z_1$, inclusive of its substituents, is more preferably from 3 to 40, most preferably from 6 to 30. In formula (B), the total number of carbon atoms included in $Z_2$ and $Y_3$, inclusive of their substituents, is more preferably from 8 to 40, most preferably from 8 to 30.

Of the compounds of formulas (A) and (B), especially preferred are those compounds of formula (A) wherein $Y_1$ is a carbonyl group, and $Z_1$ forms an indanedione, pyrrolidinedione, or pyrazolidinedione ring with —$Y_1$—C(═CH—$X_1$)—C(═O)—. Those compounds of formula (A) wherein $Z_1$ forms a pyrazolidinedione ring are most preferred.

The compounds of formulas (A) and (B) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

The compounds of formulas (A) and (B) may have incorporated therein a ballast group or polymer commonly used in immobile photographic additives such as couplers. The compounds of formulas (A) and (B) having a ballast group incorporated therein are preferred. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The compounds of formulas (A) and (B) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). The compounds of formulas (A) and (B) bearing a group containing recurring ethylenoxy or propylenoxy units or an (alkyl, aryl or heterocyclic) thio group are preferred. Exemplary such groups are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

Illustrative, non-limiting examples of the compounds of formulas (A) and (B) are given below.

1

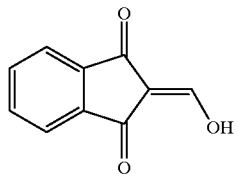

2

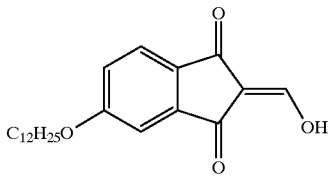

3

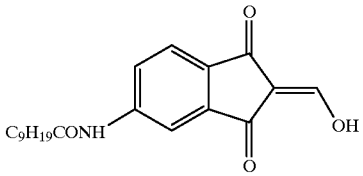

4

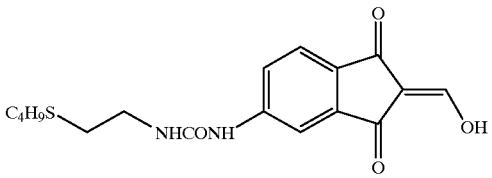

5

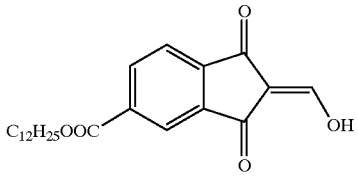

-continued
6
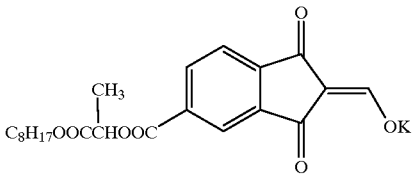
7
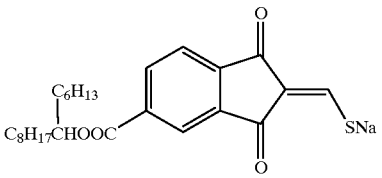
8
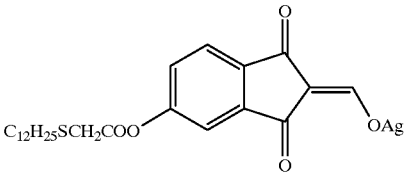
9
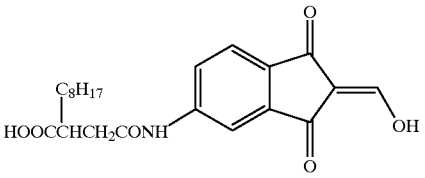
10
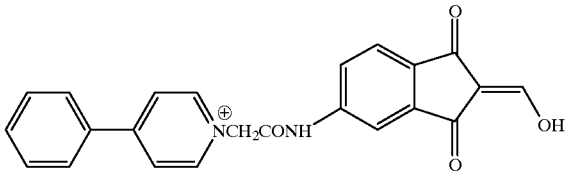
11
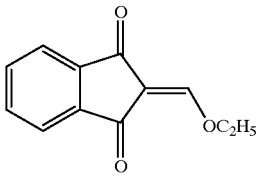
12
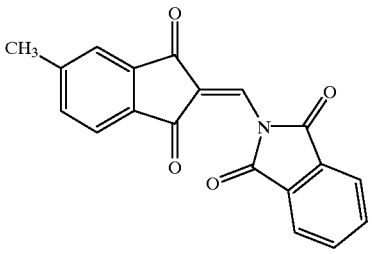

-continued
13
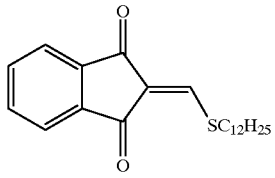
14
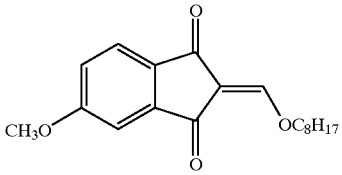
15
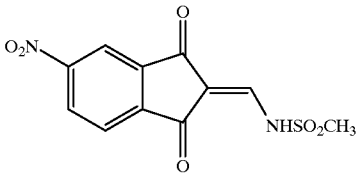
16
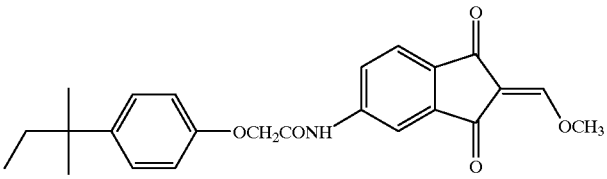
17
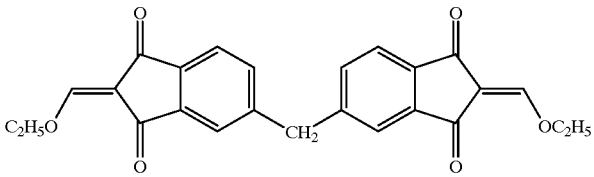
18
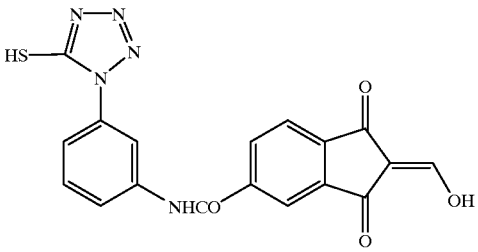
19
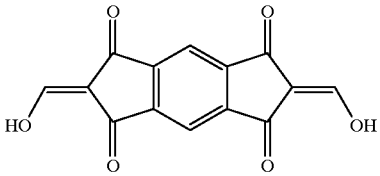

-continued
20
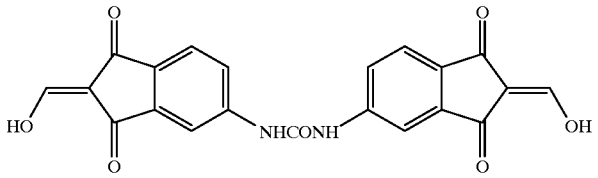
21
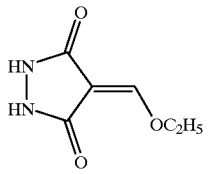
22
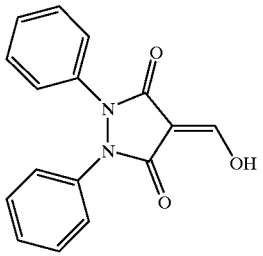
23
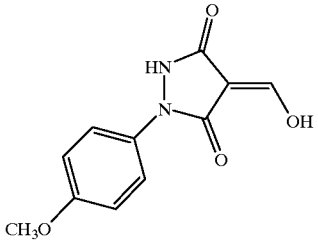
24
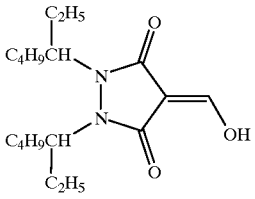
25
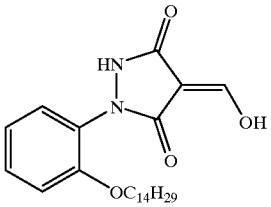
26
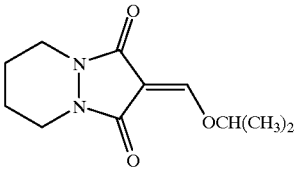

-continued
27
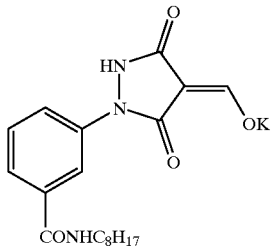
28
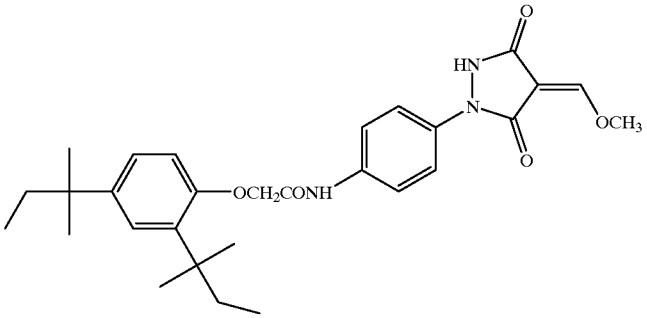
29
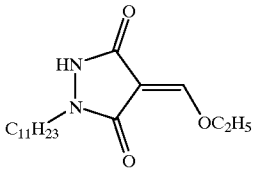
30
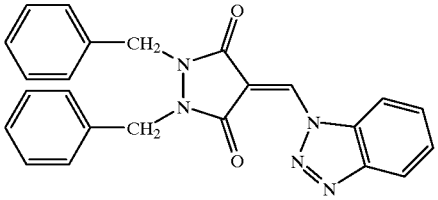
31
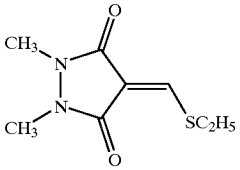
32
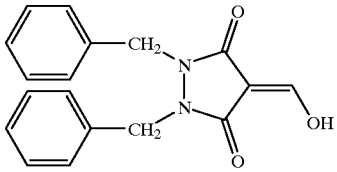

-continued
33
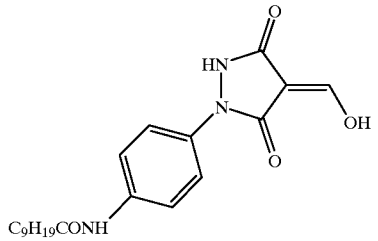
34
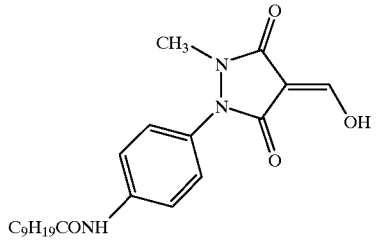
35
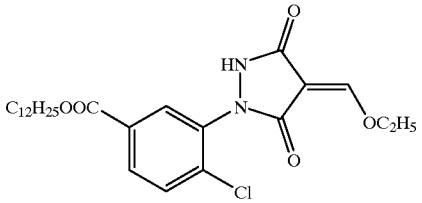
36
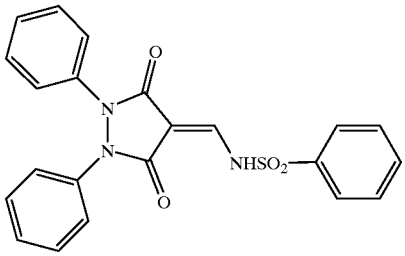
37
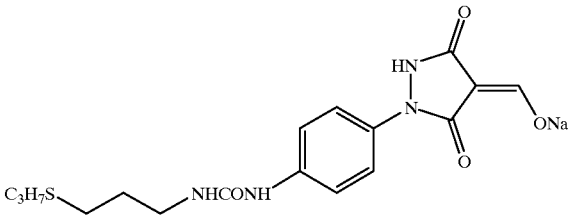
38
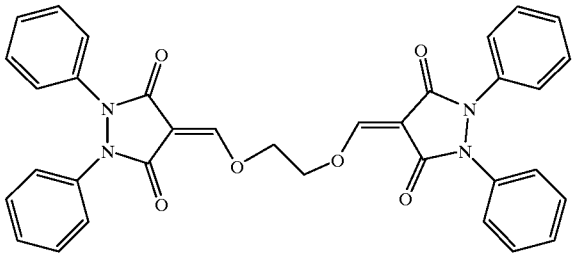

-continued
39
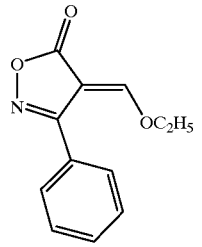
40
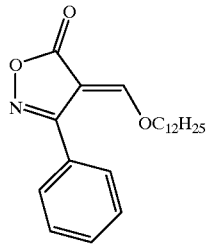
41
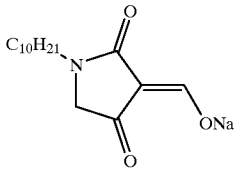
42
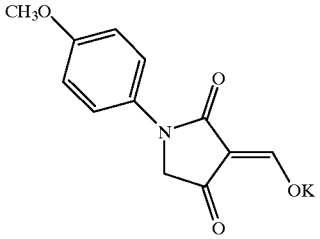
43
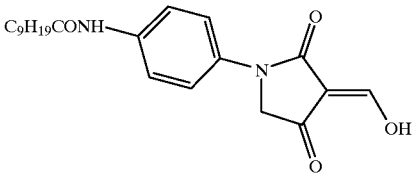
44
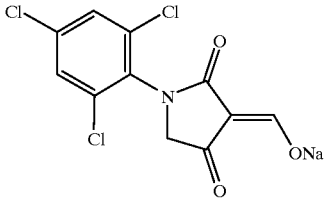
45
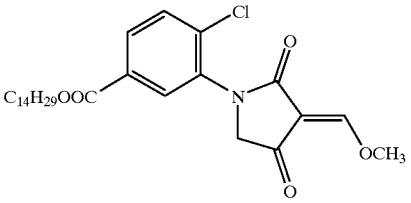

-continued
46
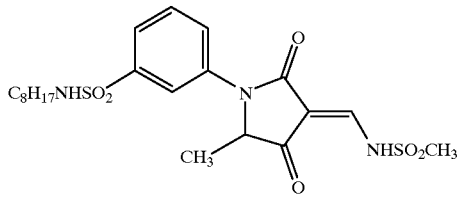
47
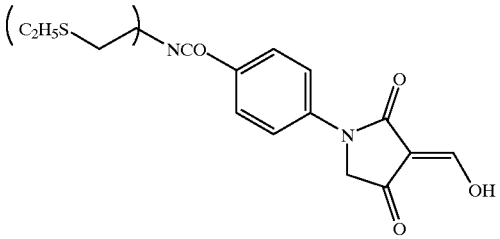
48
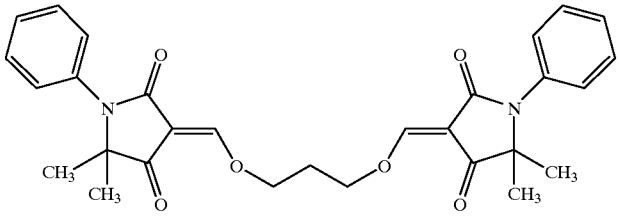
49
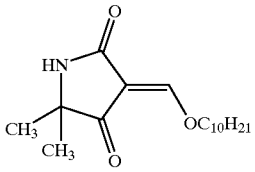
50
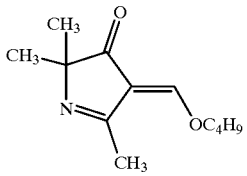
51
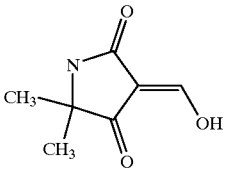
52
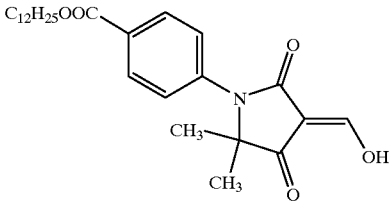

-continued
53
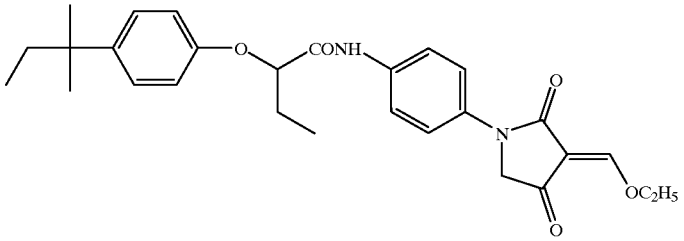
54
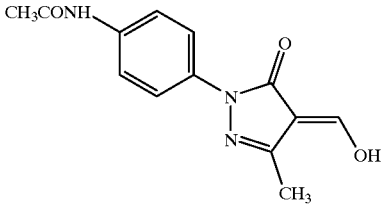
55
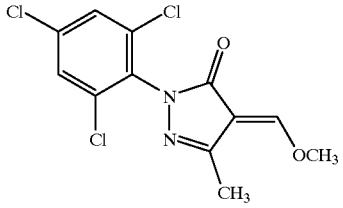
56
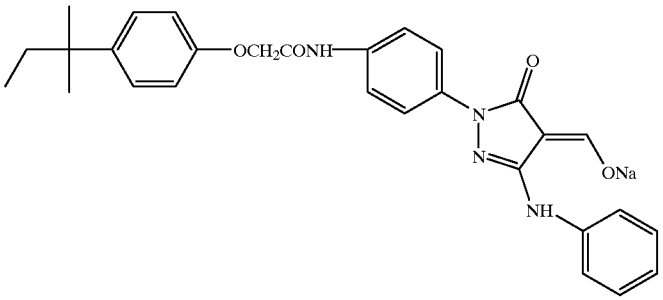
57
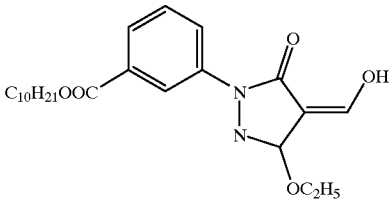
58
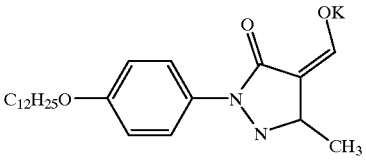
59
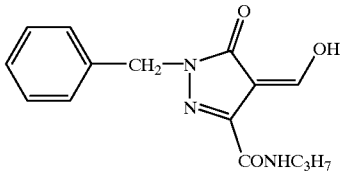

-continued
60
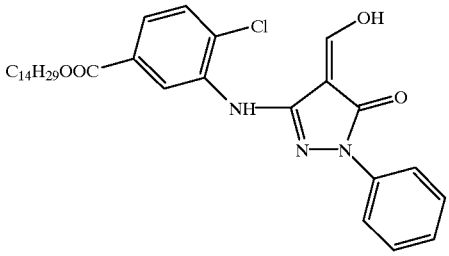
61
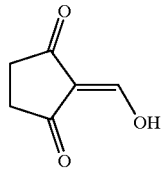
62
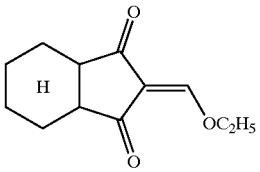
63
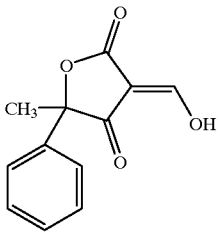
64
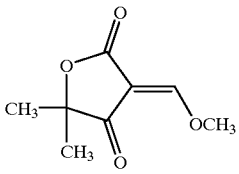
65
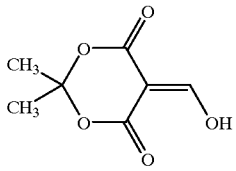
66
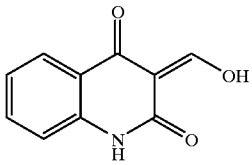

-continued
67
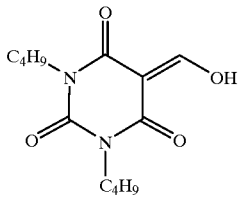
68
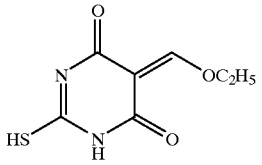
69
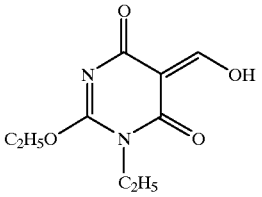
70
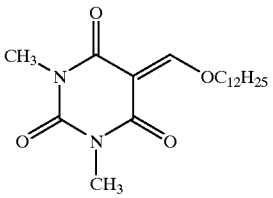
71
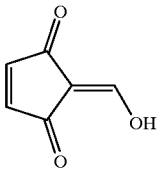
72
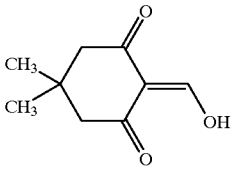
73
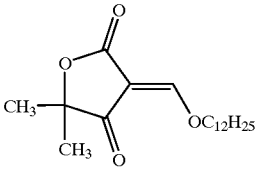

-continued
74
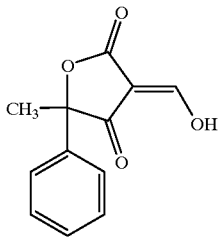
75
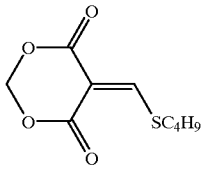
76
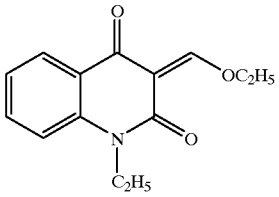
77
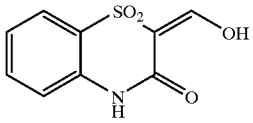
78
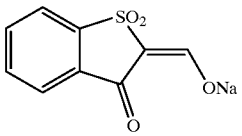
79
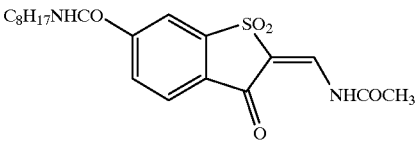
80
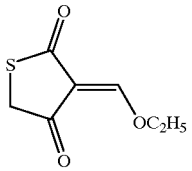
81
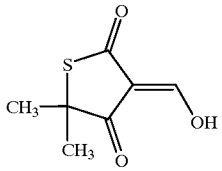

-continued
82
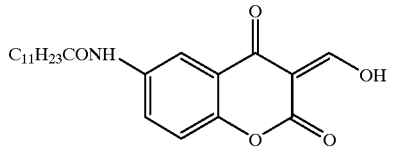
83
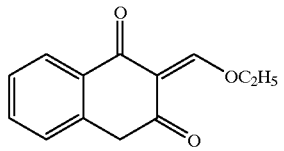
84
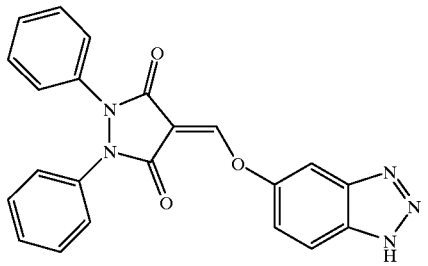
85
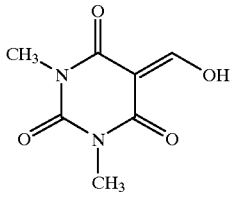
86
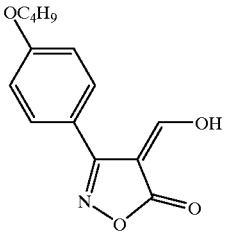
87
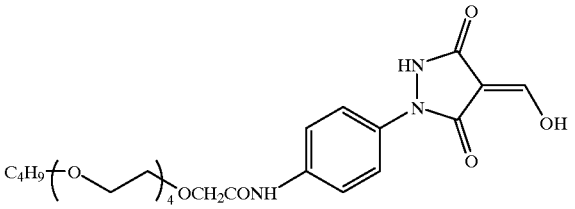
88
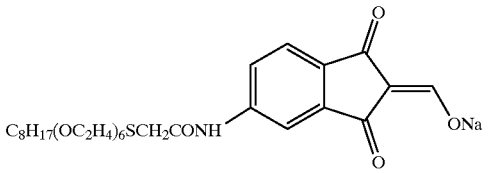

-continued
89
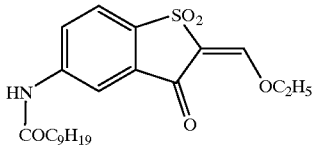
90
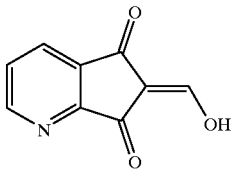
91
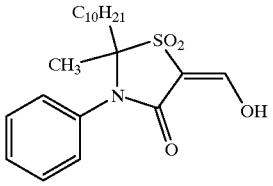
92
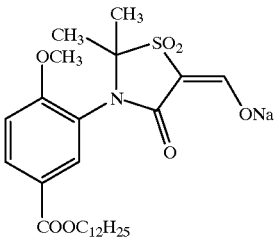
93
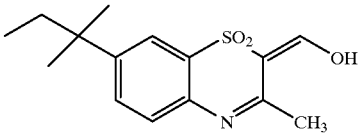
94
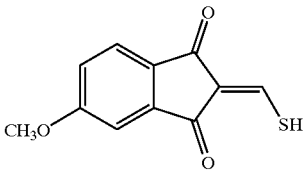
95
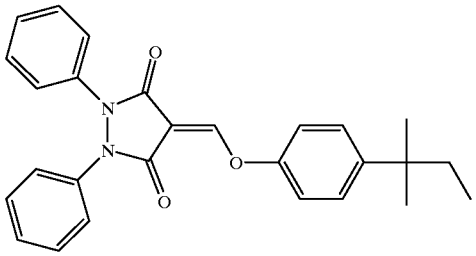

-continued
96
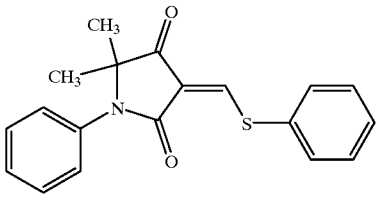
97
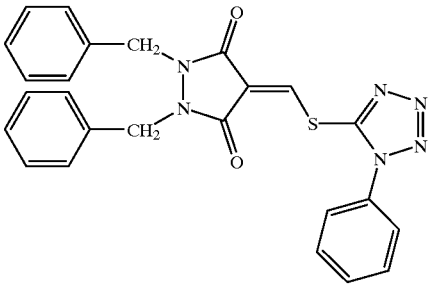
98
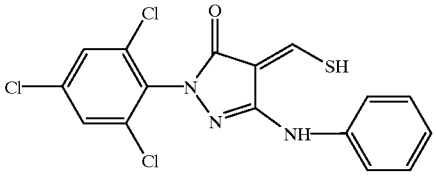
99
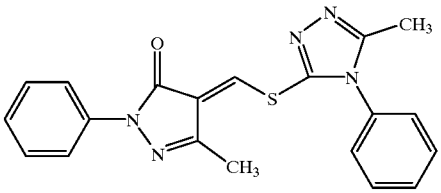
100
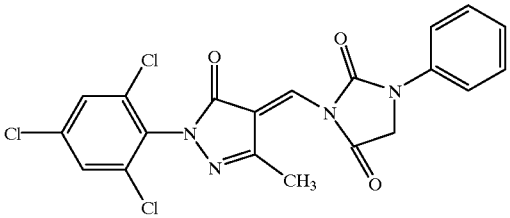
101
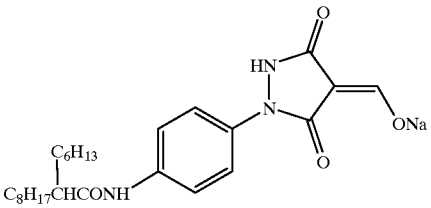

-continued
102
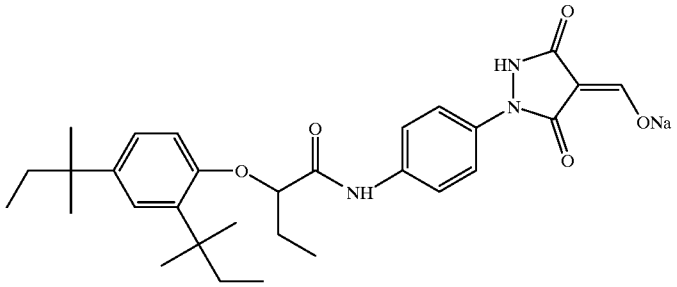
103
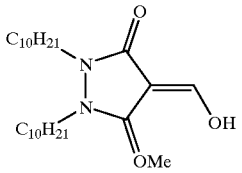
104
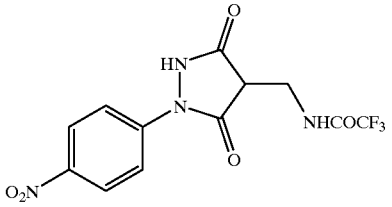
105
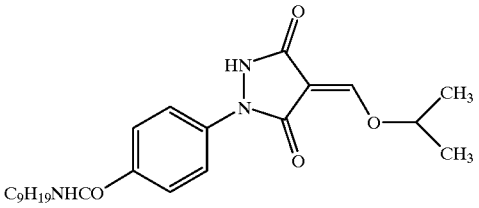
106
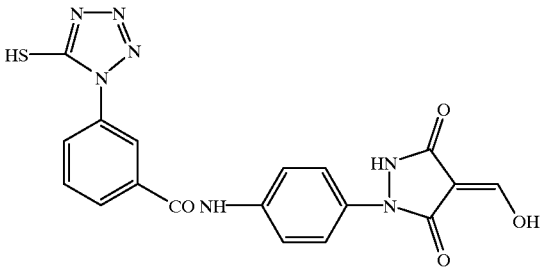
107
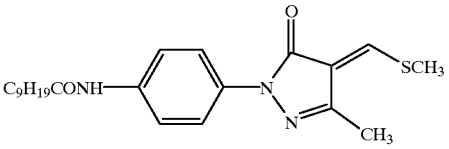
108
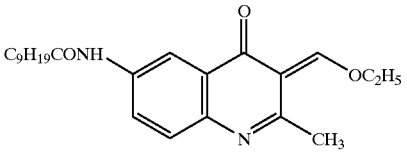

-continued

109

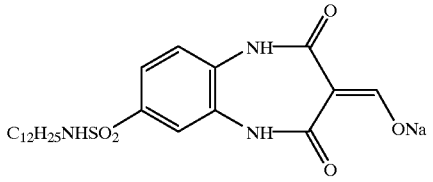

The compounds of formulas (A) and (B) can be readily synthesized by well-known methods, for example, the method described in Japanese Patent Application No. 354107/1997.

In the practice of the invention, the compound of formula (A) or (B) is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the compound of formula (A) or (B) with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the compound of formula (A) or (B) in powder form in a suitable solvent, typically water, in a ball mill, colloidal mill or ultrasonic mixer.

The compound of formula (A) or (B) may be added to any layer on an image forming layer-bearing side of a support, that is, an image forming layer or any other layer on the image forming layer side of a support, and preferably to the image forming layer or a layer disposed adjacent thereto.

The compound of formula (A) and/or (B) is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

The compounds of formulas (A) and (B) may be used alone or in admixture of two or more.

Hydrazine Derivative

Hydrazine derivatives are used in the element of the invention. The hydrazine derivatives are of the following formula (1).

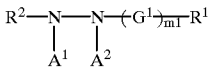

In formula (H), $R^2$ is an aliphatic, aromatic or heterocyclic group. $R^1$ is hydrogen or a block group. $G^1$ is —CO—, —COCO—, —C(=S)—, —$SO_2$—, —SO—, —PO($R^3$)— or iminomethylene group. $R^3$ is selected from the same groups as defined for $R^1$ and may be different from $R^1$. Both $A^1$ and $A^2$ are hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter ml is equal to 0 or 1. $R^1$ is an aliphatic, aromatic or heterocyclic group when m1 is 0.

In formula (1), the aliphatic groups represented by $R^2$ are preferably substituted or unsubstituted, normal, branched or cyclic alkyl, alkenyl and alkynyl groups having 1 to 30 carbon atoms.

In formula (1), the aromatic groups represented by $R^2$ are preferably monocyclic or fused ring aryl groups, for example, phenyl and naphthyl groups. The heterocyclic groups represented by $R^2$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl, alkyl and aromatic heterocyclic groups are most preferred as $R^2$.

The groups represented by $R^2$ may have substituents. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazido groups, thiosemicarbazido groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, groups containing a phosphoramide or phosphate structure, silyl groups, and stannyl groups. These substituents may be further substituted with such substituents.

Preferred substituents that $R^2$ may have include, where $R^2$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R^2$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (1), $R^1$ is hydrogen or a block group. Illustrative of the block group are aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^1$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxypropyl, hydroxymethyl, 3-methanesulfonamidopropyl, benzenesulfonamidomethyl, trifluoroacetylaminomethyl, dimethylaminomethyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, and methylthiodiphenylmethyl groups. The alkenyl groups are preferably those having 1 to 10 carbon atoms, for example, vinyl, 2-ethoxycarbonylvinyl, 2-trifluoro-2-methoxycarbonylvinyl, 2,2-dicyanovinyl, and 2-cyano-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, and 2-chloro-5-octylsulfamoylphenyl groups.

The heterocyclic groups represented by $R^1$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, quinolyl, hydantoyl, and imidazolidinyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^1$ may be substituted ones, with examples of the substituent being as exemplified for the substituent on $R^2$.

In formula (1), $R^1$ may be such a group as to induce cyclization reaction to cleave a $G^1$—$R^1$ moiety from the remaining molecule to generate a cyclic structure containing the atoms of the —$G^1$—$R^1$ moiety. Such examples are described in JP-A 29751/1988, for example.

The hydrazine derivative of formula (1) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^1$ or $R^2$ in formula (1) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^1$ or $R^2$ in formula (1) may have a plurality of hydrazino groups as substituents. In this case, the compounds of formula (1) are polymeric with respect to hydrazino groups. Exemplary polymeric compounds are described in JP-A 86134/1989, 16938/1992, 197091/1993, WO 95-32452 and 95-32453, JP-A 235264/1997, 235265/1997, 235266/1997, 235267/1997, and 17922/1997.

$R^1$ or $R^2$ in formula (1) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. No. 4,994,365 and 4,988,604, and German Patent No. 4006032.

In formula (1), each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammett substituent constants may be −0.5 or more), or a substituted or unsubstituted acyl group having up to 20 carbon atoms (preferably a benzoyl group, a benzoyl group substituted such that the sum of Hammett substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

The preferable range of the hydrazine derivatives of formula (1) is described.

In formula (1), $R^2$ is preferably phenyl, alkyl of 1 to 3 carbon atoms or aromatic heterocyclic groups.

Where $R^2$ represents phenyl or aromatic heterocyclic groups, preferred substituents thereon include nitro, cyano, alkoxy, alkyl, acylamino, ureido, sulfonamide, thioureido, carbamoyl, sulfamoyl, sulfonyl, carboxy (or salts thereof), sulfo (or salts thereof), alkoxycarbonyl, and chloro groups.

Where $R^2$ represents substituted alkyl groups of 1 to 3 carbon atoms, it is more preferably substituted methyl groups, and further preferably di- or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R^2$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Where $R^2$ represents aromatic heterocyclic groups, it is preferred that the heterocycles in $R^2$ be pyridine, quinoline, pyrimidine, triazine, benzothiazole, benzimidazole, and thiophene rings.

Most preferably, $R^2$ in formula (1) represents substituted or unsubstituted phenyl groups.

In formula (1), m1 is equal to 0 or 1. When m1 is 0, $R^1$ represents aliphatic, aromatic or heterocyclic groups. When m1 is 0, $R^1$ more preferably represents phenyl groups, substituted alkyl groups of 1 to 3 carbon atoms or alkenyl groups. Of these groups, the phenyl groups and substituted alkyl groups of 1 to 3 carbon atoms are the same as the preferred range of $R^2$ mentioned above. When $R^1$ represents alkenyl groups, preferred $R^1$ groups are vinyl groups, especially vinyl groups having one or two substituents selected from the group consisting of cyano, acyl, alkoxycarbonyl, nitro, trifluoromethyl, and carbamoyl. Exemplary are 2,2-dicyanovinyl, 2-cyano-2-methoxycarbonylvinyl, and 2-acetyl-2-ethoxycarbonylvinyl.

Preferably m1 is equal to 1.

Where $R^2$ is a phenyl or aromatic heterocyclic group and $G^1$ is —CO—, the groups represented by $R^1$ are preferably selected from hydrogen, alkyl, alkenyl, alkynyl, aryl and heterocyclic groups, more preferably from hydrogen, alkyl and aryl groups, and most preferably from hydrogen atoms and alkyl groups. Where $R^1$ represents alkyl groups, preferred substituents thereon are halogen, alkoxy, aryloxy, alkylthio, arylthio, hydroxy, sulfonamide, amino, acylamino, and carboxy groups.

Where $R^2$ is a substituted methyl group and $G^1$ is —CO—, the groups represented by $R^1$ are preferably selected from hydrogen, alkyl, aryl, heterocyclic, alkoxy, and amino groups (including unsubstituted amino, alkylamino, arylamino and heterocyclic amino groups), more preferably from hydrogen, alkyl, aryl, heterocyclic, alkoxy, alkylamino, arylamino and heterocyclic amino groups. Where $G^1$ is —COCO—, independent of $R^2$, $R^1$ is preferably selected from alkoxy, aryloxy, and amino groups, more preferably from substituted amino groups, specifically alkylamino, arylamino and saturated or unsaturated heterocyclic amino groups.

Where $G^1$ is —$SO_2$—, independent of $R^2$, $R^1$ is preferably selected from alkyl, aryl and substituted amino groups.

In formula (1), $G^1$ is preferably —CO— or —COCO—, and most preferably —CO—.

Of the hydrazine derivatives of formula (1), hydrazine derivatives of the following formula (2) are especially preferred.

$$R^{11}\text{—NHNH—CO—C}(R^{22})(R^{33})\text{—X} \quad (2)$$

In formula (2), $R^{11}$ represents an aromatic group. $R^{22}$ and $R^{33}$, which may be the same or different, independently represent hydrogen or a substituent. X is —OH, —OR, —OCOR, —SH, —SR, —NHCOR, —$NHSO_2R$, —$NHCON(R_N)R_N'$, —$NHSO_2N(R_N)R_N'$, —$NHCO_2R$, —$NHCOCON(R_N)R_N'$, —$NHCOCO_2R$, —$NHCON(R_N)SO_2R$ or —$N(R_N)R_N'$. R represents a substituted or unsubstituted alkyl, aryl or heterocyclic group. $R_N$ and $R_N'$, which may be the same or different, independently represent hydrogen or a substituted or unsubstituted alkyl, aryl or heterocyclic group.

The compounds of formula (2) are described in more detail.

In formula (2), the aromatic groups represented by $R^{11}$ are monocyclic or fused ring aryl groups, for example, phenyl and naphthyl groups.

The groups represented by $R^{11}$ may have substituents. Typical substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazido groups, thiosemicarbazido groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl) sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoramide or phosphate structure. These substituents may be further substituted with such substituents.

Preferred substituents that $R^{11}$ may have include alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (2), $R^{11}$ more preferably represents substituted or unsubstituted phenyl groups. Preferred substituents on the phenyl group include nitro, cyano, alkoxy, alkyl, acylamino, ureido, sulfonamide, thioureido, carbamoyl, sulfamoyl, sulfonyl, carboxy (or salts thereof), sulfo (or salts thereof), alkoxycarbonyl groups, and chlorine atoms. When $R^{11}$ in formula (2) represents a substituted phenyl group, the total number of carbon atoms is preferably 6 to 40, especially 6 to 30.

In formula (2), $R^{22}$ and $R^{33}$ represent hydrogen or substituents. The substituents are exemplified by the exemplary substituents that $R^{11}$ may have. Preferred substituents are those having 0 to 10 carbon atoms in total, especially 0 to 6 carbon atoms in total. Illustrative of $R^{22}$ and $R^{33}$ are hydrogen atom, halogen atoms (e.g., fluorine and chlorine atoms), alkyl groups (e.g., methyl, ethyl, and benzyl), aryl groups (e.g., phenyl and 4-methylphenyl), alkoxy groups (e.g., methoxy and isopropoxy), aryloxy groups (e.g., phenoxy), amino groups (e.g., dimethylamino and propylamino), alkoxycarbonyl groups (e.g., ethoxycarbonyl and benzyloxycarbonyl), and aryloxycarbonyl groups (e.g., phenoxycarbonyl and naphthoxycarbonyl). $R^{22}$ and $R^{33}$ may together form a cyclic structure. The groups represented by $R^{22}$ and $R^{33}$ may have substituents, examples of which are the same as the exemplary substituents that $R^{11}$ may have, preferred examples of which are those having 0 to 10 carbon atoms in total, especially 0 to 6 carbon atoms in total, and illustrative examples of which are the same as the exemplary substituents represented by $R^{22}$ and $R^{33}$.

Most preferably, $R^{22}$ and $R^{33}$ are hydrogen atoms.

In formula (2), X is —OH, —OR, —OCOR, —SH, —SR, —NHCOR, —$NHSO_2R$, —$NHCON(R_N)R_N'$, —$NHSO_2N(R_N)R_N'$, —$NHCO_2R$, —$NHCOCON(R_N)R_N'$, —$NHCOCO_2R$, —$NHCON(R_N)SO_2R$ or —$N(R_N)R_N'$. R represents substituted or unsubstituted groups having 1 to 20 carbon atoms in total, preferably 1 to 10 carbon atoms in total, typically alkyl groups (e.g., methyl, ethyl, butyl, trifluoromethyl, difluoromethyl, benzyl, 3-hydroxypropyl, 2-carboxyethyl, ethoxycarbonylmethyl, and dimethylaminoethyl), aryl group (e.g., phenyl, p-t-aminophenyl, naphthyl, perfluorophenyl, 4-methoxyphenyl, 4-dimethylanilino and 2-methanesulfonamidophenyl), and heterocyclic groups (e.g., morpholino, imidazolyl, pyridyl, and 2,2,6,6-tetramethylpiperidin-4-yl). $R_N$ and $R_N'$ represent hydrogen or substituted or unsubstituted groups having 1 to 20 carbon atoms in total, preferably 1 to 10 carbon atoms in total, typically, alkyl, aryl and heterocyclic groups. When $R_N$ and $R_N'$ represent alkyl, aryl or heterocyclic groups, examples of these groups are the same as the substituents represented by R. The groups represented by R, $R_N$ and $R_N'$ may further have substituents, examples of which are the same as the substituents that $R^{11}$ may have, preferred examples of which are those having 0 to 10 carbon atoms in total, especially 0 to 6 carbon atoms in total, and illustrative examples of which are the same as the exemplary substituents represented by R.

Illustrative groups represented by X in formula (2) include hydroxy, methoxy, 2-hydroxyethoxy, phenoxy, p-ethylphenoxy, p-t-aminophenoxy, acetyloxy, benzoyloxy, mercapto, methylthio, carboxymethylthio, phenylthio, 5-phenyltetrazolyl-2-thio, phenylsulfonamide, perfluorophenylsulfonamide, methanesulfoneamide, trifluoromethanesulfoneamide, acetamide, trifluoroacetamide, perfluorobenzamide, unsubstituted amino, dimethylamino, diethylamino, and propylamino groups.

More preferably, X in formula (2) represents a group having 0 to 20 carbon atoms in total, further preferably 0 to 15 carbon atoms in total, that is, —OH, —OR, —OCOR, —SH, —SR, —NHCOR, —$NHSO_2R$, or —$N(R_N)R_N'$, further preferably —OH, —OR, —NHCOR, —$NHSO_2R$, or —$N(R_N)R_N'$.

Illustrative, non-limiting, examples of the hydrazine derivative are given below.

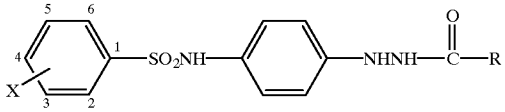
| | X = | R = —H | —$C_2F_4$—COOH or (—$C_2F_4$—$COO^{\ominus}K^{\oplus}$) | 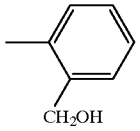 | 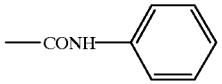 |
|---|---|---|---|---|---|
| H-1 | 3-NHCO—$C_9H_{19}$ (n) | 1a | 1b | 1c | 1d |
| H-2 | 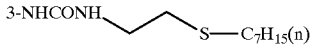 | 2a | 2b | 2c | 2d |
| H-3 | 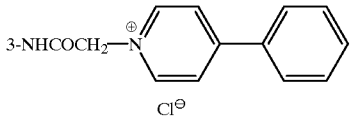 | 3a | 3b | 3c | 3d |
| H-4 | 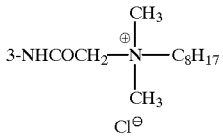 | 4a | 4b | 4c | 4d |
| H-5 | 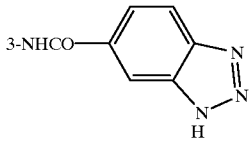 | 5a | 5b | 5c | 5d |
| H-6 | 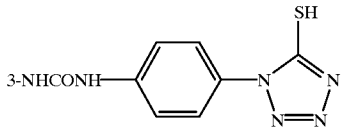 | 6a | 6b | 6c | 6d |

-continued
| H-7 | 2,4-$(CH_3)_2$-3-$SCH_2H_4$—$(OC_2H_4)_4$—$OC_8H_{17}$ | 7a | 7b | 7c | 7d |
|---|---|---|---|---|---|
| | 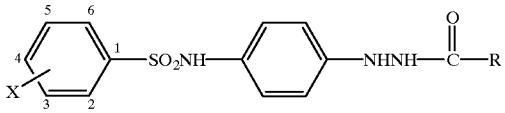 | | | | |
| | | R = | | | |
| | X = | —H | —$CF_2H$ | 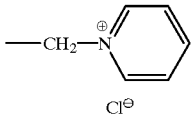 | 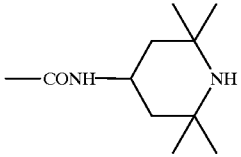 |
| H-8 | 3-$CONHCH_2CH(C_2H_5)C_4H_9$ | 8a | 8e | 8f | 8g |
| H-9 | 6-$OCH_3$-3-$C_5H_{11}$ (t) | 9a | 9e | 9f | 9g |
| H-10 | 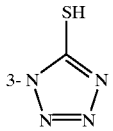 | 10a | 10e | 10f | 10g |
| H-11 | 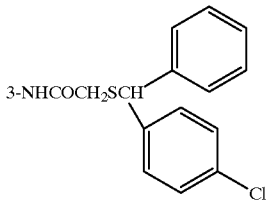 | 11a | 11e | 11f | 11g |
| H-12 | 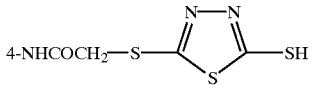 | 12a | 12e | 12f | 12g |

-continued
| | | | | | |
|---|---|---|---|---|---|
| H-13 | 3-NHCOCH(CH$_2$COOH)—C$_8$H$_{17}$ | 13a | 13e | 13f | 13g |
| H-14 | 3,5—(CONHCH$_2$CH(C$_2$H$_5$)—C$_4$H$_9$)$_2$ | 14a | 14e | 14f | 14g |
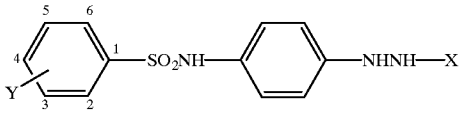
| | | X = | | | |
|---|---|---|---|---|---|
| | Y = | —CHO | —COCF$_3$ | —SO$_2$CH$_3$ | —P(=O)(OC$_2$H$_5$)$_2$ |
| H-15 | 3-NHCOCH$_2$N$^{\oplus}$(C$_5$H$_4$)—CONHC$_4$H$_9$ $^{\ominus}$Cl• | 15a | 15h | 15i | 15j |
| H-16 | 4-NHCO(CH$_2$)$_2$N$^{\oplus}$(C$_4$H$_8$)—C$_6$H$_{13}$ •Cl$^{\ominus}$ | 16a | 16h | 16i | 16j |
| H-17 | 3-SO$_2$NH—(CH$_2$)$_4$—(O—(CH$_2$)$_4$)$_4$—OC$_4$H$_9$ | 17a | 17h | 17i | 17j |
| H-18 | 3,4-(COOCH(CH$_3$)COOC$_4$H$_9$)$_2$ | 18a | 18h | 18i | 18j |
| H-19 | 3-NHCO—(CH$_2$)$_4$—(C$_3$H$_4$S$_2$) | 19a | 19h | 19i | 19j |

-continued
| | | | | | |
|---|---|---|---|---|---|
| H-20 | 3-$NHSO_2NH—C_8H_{17}$ | 20a | 20h | 20i | 20j |
| H-21 | 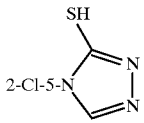 | 21a | 21h | 21i | 21j |
| | | R = | | | |
| | | —H | —$CF_3$ | 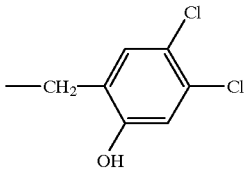 | 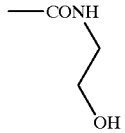 |
| H-22 | 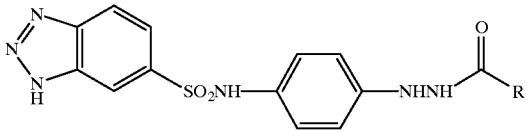 | 22a | 22h | 22k | 22l |
| H-23 | 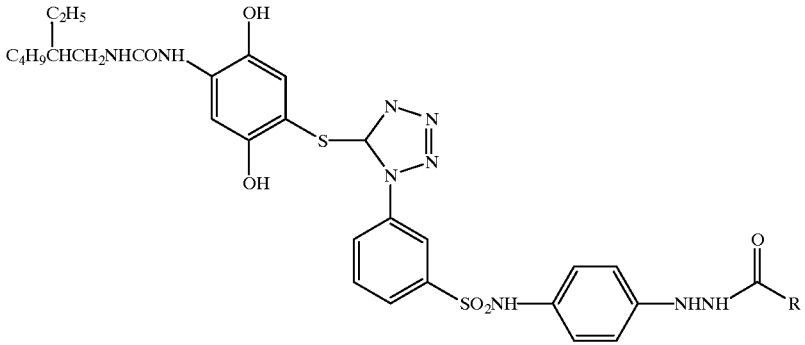 | 23a | 23h | 23k | 23l |

-continued
| | | | | | |
|---|---|---|---|---|---|
| H-24 | 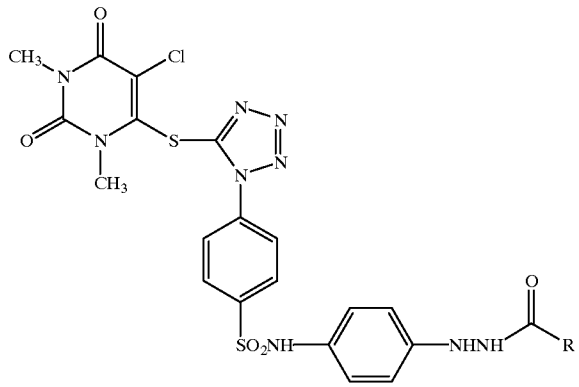 | 24a | 24h | 24k | 24l |
| H-25 | 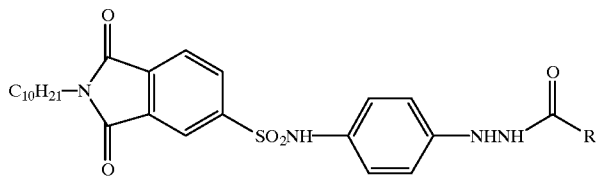 | 25a | 25h | 25k | 25l |
| H-26 | 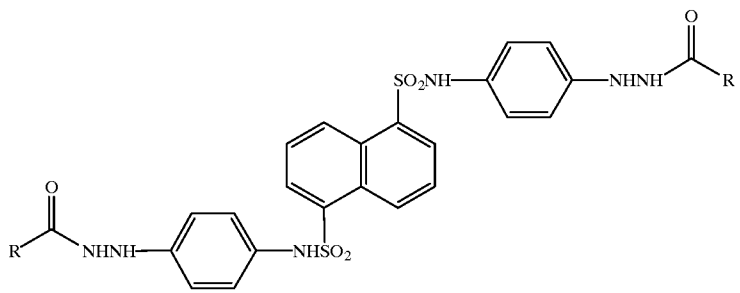 | 26a | 26h | 26k | 26l |

-continued
| | | | | | |
|---|---|---|---|---|---|
| H-27 | 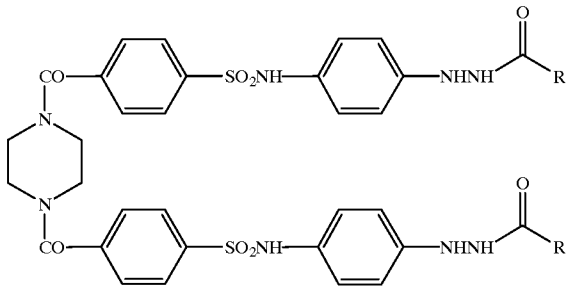 | 27a | 27h | 27k | 27l |
| H-28 | 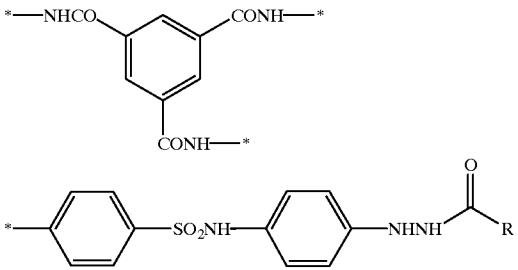 | 28a | 28h | 28k | 28l |
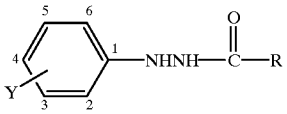
| Y = | R = —H | R = —$CH_2OCH_3$ | R = 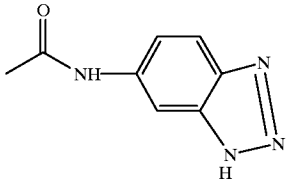 | R = 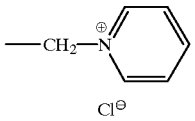 $Cl^{\ominus}$ |
|---|---|---|---|---|
| | | | | |
|---|---|---|---|---|
| H-29 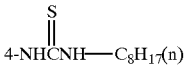 | 29a | 29m | 29n | 29f |

-continued
| | | | | | |
|---|---|---|---|---|---|
| H-30 | 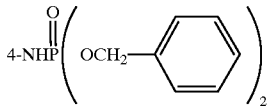 | 30a | 30m | 30n | 30f |
| H-31 | 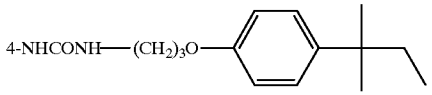 | 31a | 31m | 31n | 31f |
| H-32 | 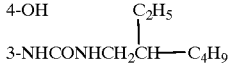 | 32a | 32m | 32n | 32f |
| H-33 | 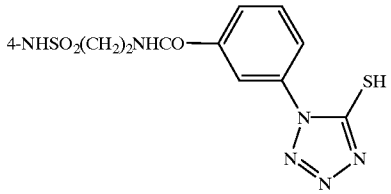 | 33a | 33m | 33n | 33f |
| H-34 | 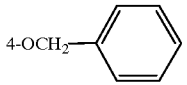 | 34a | 34m | 34n | 34f |

-continued
| | | | | | |
|---|---|---|---|---|---|
| H-35 | 4-NHCONHN—(CH$_2$—C$_6$H$_4$)$_2$ | 35a | 35m | 35n | 35f |
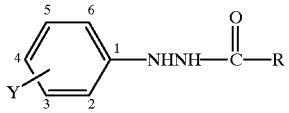
| | | R = | | | |
|---|---|---|---|---|---|
| | Y = | —H | —CF$_2$SCH$_3$ | —CONHCH$_3$ | 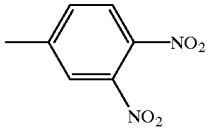 |
| H-36 | 2-NHSO$_2$CH$_3$-4-NHCONH(CH$_2$)$_3$—C$_6$H$_{11}$ | 36a | 36o | 36p | 36q |
| H-37 | 2-OCH$_3$-4-NHSO$_2$C$_{12}$H$_{25}$ | 37a | 37o | 37p | 37q |
| H-38 | 3-NHCOC$_{11}$H$_{23}$-4-NHSO$_2$CF$_3$ | 38a | 38o | 38p | 38q |
| H-39 | 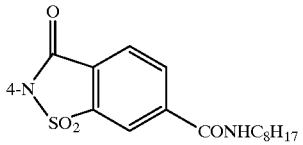 | 39a | 39o | 39p | 39q |
| H-40 | 4-OCO(CH$_2$)$_2$COOC$_6$H$_{13}$ | 40a | 40o | 40p | 40q |

-continued
| | | | | | |
|---|---|---|---|---|---|
| H-41 | 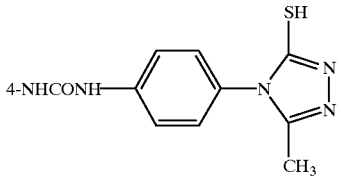 | 41a | 41o | 41p | 41q |
| H-42 | 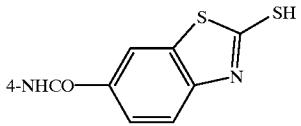 | 42a | 42o | 42p | 42q |
| H-43 | 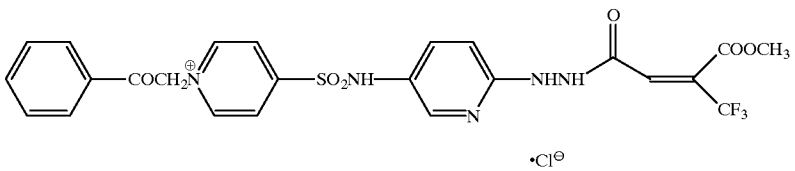 | | | | |
| H-44 | 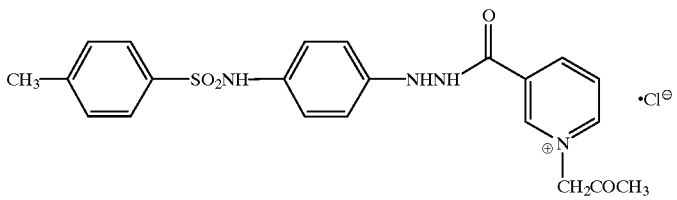 | | | | |
| H-45 | 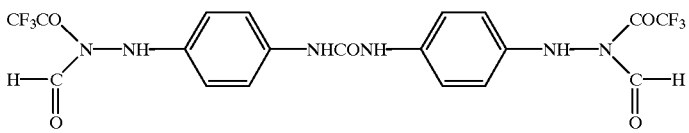 | | | | |

-continued
H-46
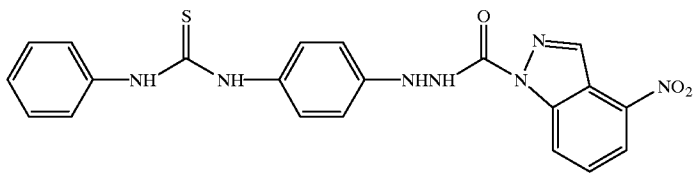
H-47
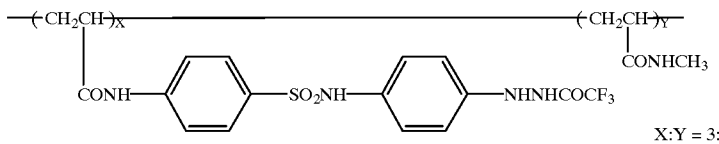
X:Y = 3:97
average molecular weight ~ 100,000
H-48
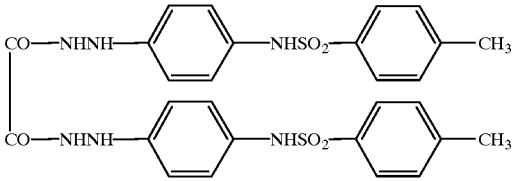
H-49
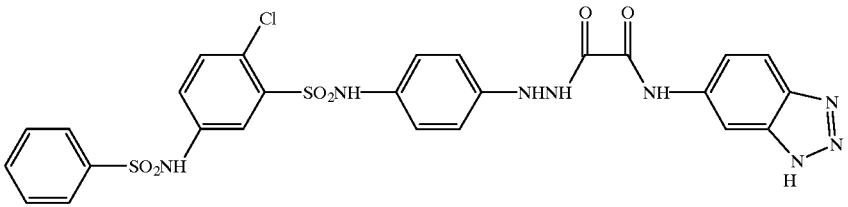
H-50
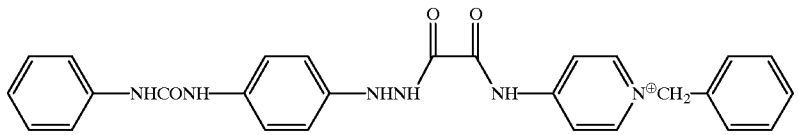
•Cl⊖

-continued
H-51
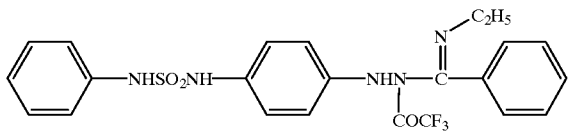
H-52
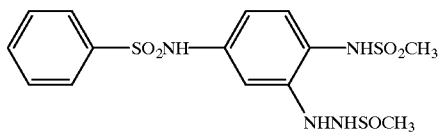
H-53
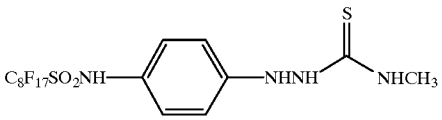
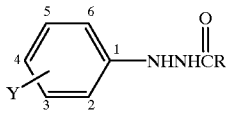
| | | R = | | | |
|---|---|---|---|---|---|
| | Y = | —H | —$CH_2OCH_3$ | —$CH_2O$— 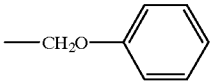 | —$CONHC_3H_7$ |
| H-54 | 2-$OCH_3$ | 54a | 54m | 54r | 54s |
| H-55 | 2-$OCH_3$<br>5-$C_8H_{17}$ (t) | 55a | 55m | 55r | 55s |
| H-56 | 4-$NO_2$ | 56a | 56m | 56r | 56s |
| H-57 | 4-$CH_3$ | 57a | 57m | 57r | 57s |
| H-58 | 4-NHCO— 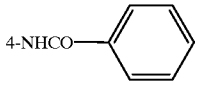 | 58a | 58m | 58r | 58s |

-continued
| | | | | | |
|---|---|---|---|---|---|
| H-59 | 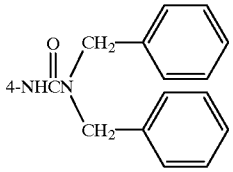 | 59a | 59m | 59r | 59s |
| | | 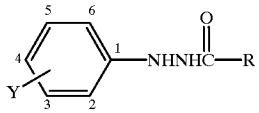 | | | |
| | | R = | | | |
| | Y = | —H | 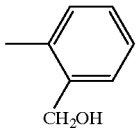 | 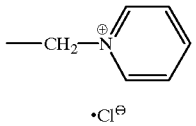 | 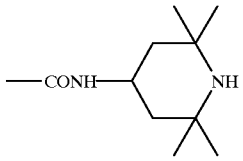 |
| H-60 | 2-$OCH_3$<br>5-$OCH_3$ | 60a | 60c | 60f | 60g |
| H-61 | 4-$C_8H_{17}$ (t) | 61a | 61c | 61f | 61g |
| H-62 | 4-$OCH_3$ | 62a | 62c | 62f | 62g |
| H-63 | 3-$NO_2$ | 63a | 63c | 63f | 63g |
| H-64 | 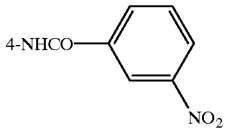 | 64a | 64c | 64f | 64g |
| H-65 | 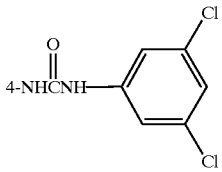 | 65a | 65c | 65f | 65g |

-continued
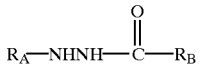
| | $R_A$ = | $R_B$ = —H | $R_B$ = —$CH_2O$—$C_6H_4$—$NO_2$ | $R_B$ = —$C_6H_4$—$N(CH_3)_2$ | $R_B$ = —NH—$C_6H_5$ |
|---|---|---|---|---|---|
| H-66 | 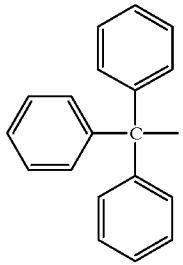 | 66a | 66u | 66v | 66t |
| H-67 | 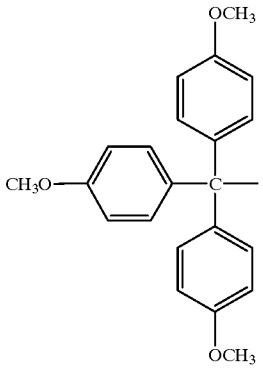 | 67a | 67u | 67v | 67t |

-continued
| | | | | | |
|---|---|---|---|---|---|
| H-68 | 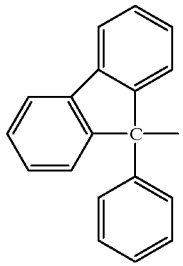 | 68a | 68u | 68v | 68t |
| H-69 | 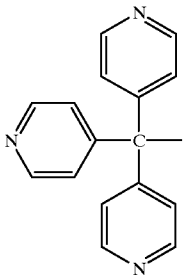 | 69a | 69u | 69v | 69t |
| H-70 | 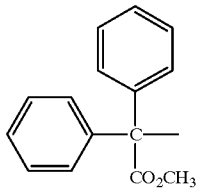 | 70a | 70u | 70v | 70t |
| H-71 | 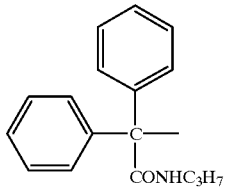 | 71a | 71u | 71v | 71t |

-continued
| | | $R_A—NHNH—C(=O)—R_B$ | | | |
|---|---|---|---|---|---|
| | | $R_B$ = | | | |
| | $R_A$ = | $—C(=O)NHC_3H_7$ | $—C(=O)O—C_4H_9(t)$ | $—OC_4H_9(t)$ | 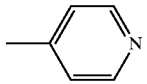 |
| H-72 | 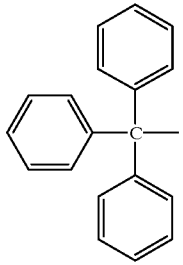 | 72s | 72x | 72y | 72w |
| H-73 | 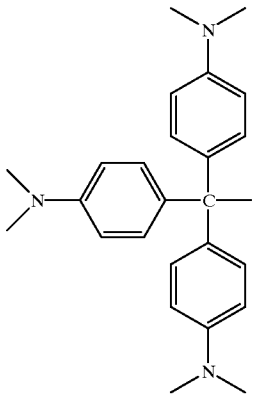 | 73s | 73x | 73y | 73w |

-continued
| | | | | | |
|---|---|---|---|---|---|
| H-74 | 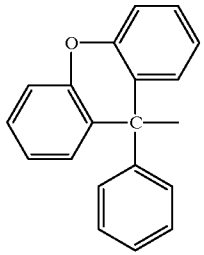 | 74s | 74x | 74y | 74w |
| H-75 | 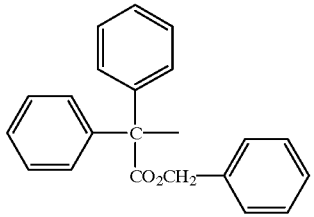 | 75s | 75x | 75y | 75w |
| H-76 | 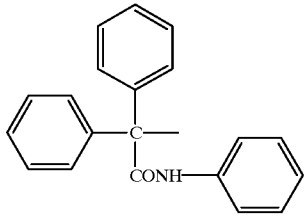 | 76s | 76x | 76y | 76w |

-continued
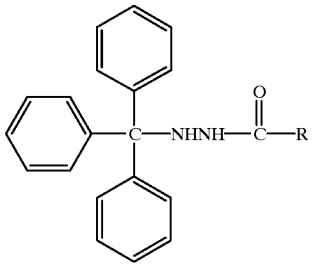
R =
H-77
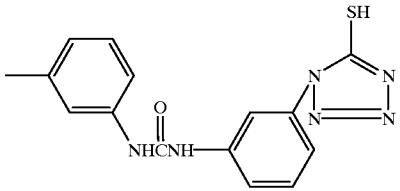
H-78
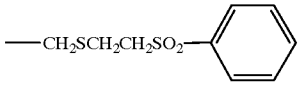
H-79 $—CH_2OCH_2CH_2SCH_2CH_2OCH_3$
H-80 $—CF_2CF_2COOH$
H-81
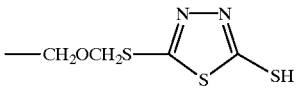
H-82
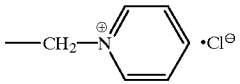

-continued
H-83
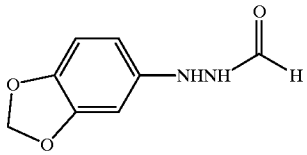
H-84
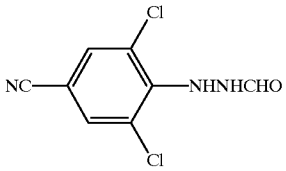
H-85
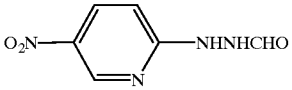
H-86
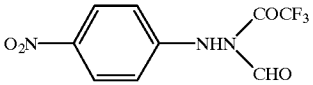
H-87
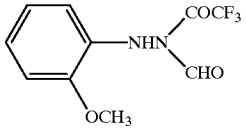
H-88
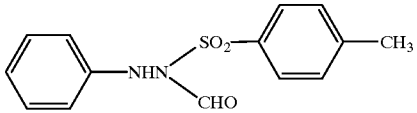
H-89
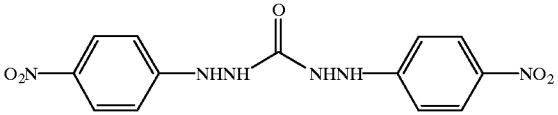

-continued
H-90
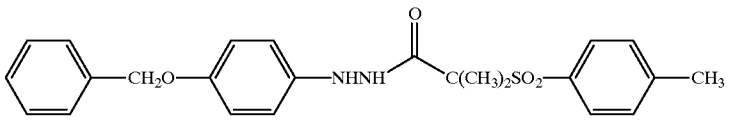
H-91
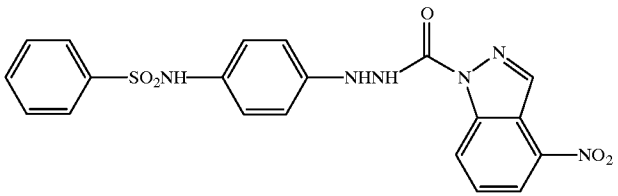
H-92
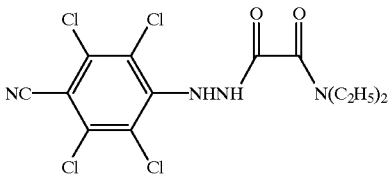
H-93
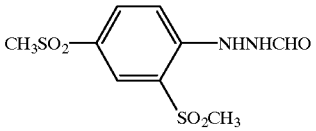

-continued
H-94
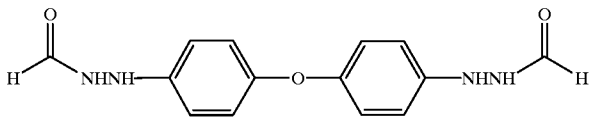
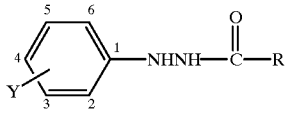
| | Y = | R = $-CH_2O-C_6H_4-C_2H_5$ | R = $-CH(C_2H_5)-C_6H_4-C(CH_3)_2-CH_2-CH_3$ | R = $-CH_2S-C_6H_5$ | R = $-CH_2-Cl$ |
|---|---|---|---|---|---|
| H-95 | 4-NHCOCH($C_2H_5$)-$C_6H_3$-$C(CH_3)_2-CH_2-CH_3$ | 95-1 | 95-2 | 95-3 | 95-4 |
| H-96 | 4-COOH | 96-1 | 96-2 | 96-3 | 96-4 |
| H-97 | 4-NH-C(=S)-$NHC_2H_5$ | 97-1 | 97-2 | 97-3 | 97-4 |
| H-98 | 4-$NHSO_2$-$C_6H_4$-$NHCOC_9H_{19}$ | 98-1 | 98-2 | 98-3 | 98-4 |

-continued
| | | | | | |
|---|---|---|---|---|---|
| H-99 | 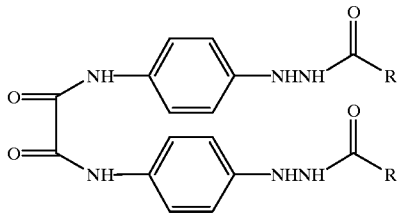 | 99-1 | 99-2 | 99-3 | 99-4 |
| H-100 | 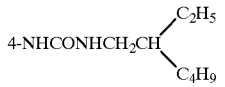 | 100-1 | 100-2 | 100-3 | 100-4 |
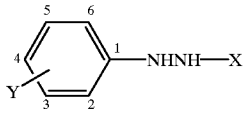
X =
Y =
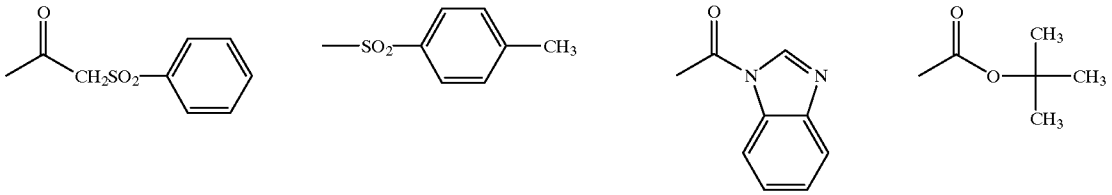

-continued
| | | | | | |
|---|---|---|---|---|---|
| H-101 | 4-$NO_2$ | 101-5 | 101-6 | 101-7 | 101y |
| H-102 | 2,4-$OCH_3$ | 102-5 | 102-6 | 102-7 | 102y |
| H-103 | 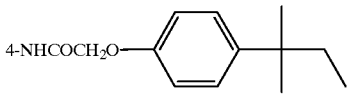 | 103-5 | 103-6 | 103-7 | 103y |
| | | X = | | | |
| | Y = | 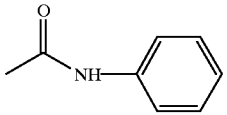 | 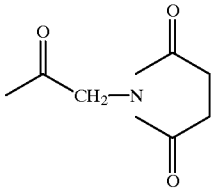 | 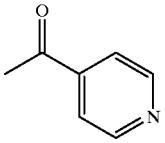 | 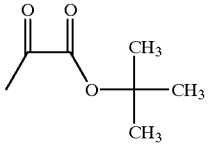 |
| H-104 | 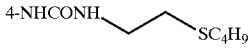 | 104-8 | 104-9 | 104w' | 104x |
| H-105 | 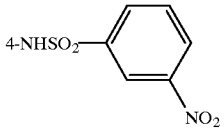 | 105-8 | 105-9 | 105w' | 105x |
| | | Y—NH NH—X | | | |
| | | X = | | | |
| | Y = | 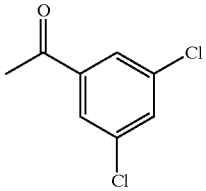 | 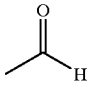 | 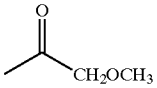 | 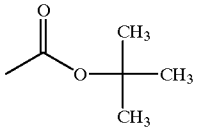 |

-continued
| | | | | | |
|---|---|---|---|---|---|
| H-106 | 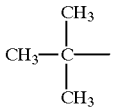 | 106-10 | 106a | 106m | 106y |
| H-107 | 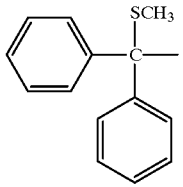 | 107-10 | 107a | 107m | 107y |
| H-108 | 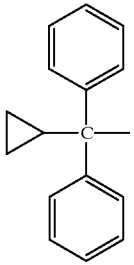 | 108-10 | 108a | 108m | 108y |
| H-109 | 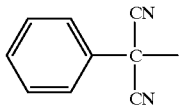 | 109-10 | 109a | 109m | 109y |
| H-110 | 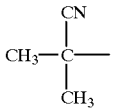 | 110-10 | 110a | 110m | 110y |
| H-111 | 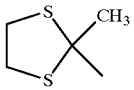 | 111-10 | 111a | 111m | 111y |

-continued
| | | Y—NH NH—X | | | |
|---|---|---|---|---|---|
| | | X = | | | |
| | Y = | 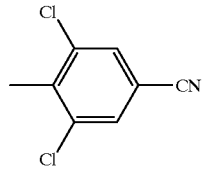 | 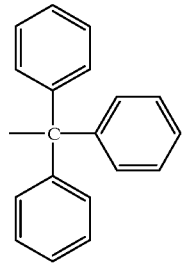 | 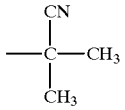 | 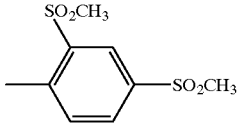 |
| H-112 | 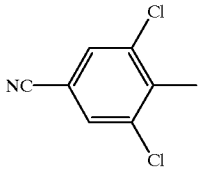 | 112-11 | 112-12 | 112-13 | 112-14 |
| H-113 | 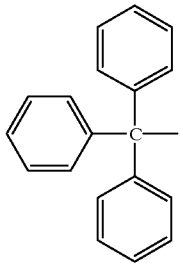 | 113-11 | 113-12 | 113-13 | 113-14 |
| H-114 | 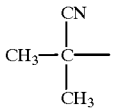 | 114-11 | 114-12 | 114-13 | 114-14 |

-continued
| | | | | | |
|---|---|---|---|---|---|
| H-115 | 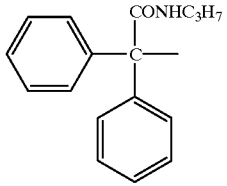 | 115-11 | 115-12 | 115-13 | 115-14 |
| H-116 | 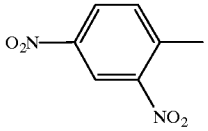 | 116-11 | 116-12 | 116-13 | 116-14 |
| H-117 | 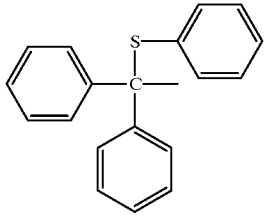 | 117-11 | 117-12 | 117-13 | 117-14 |
H-118
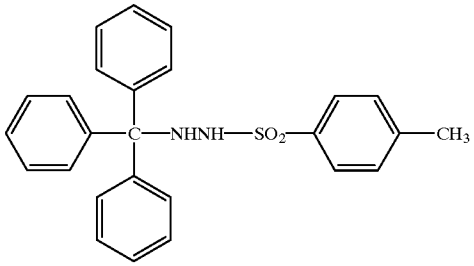

-continued
H-119
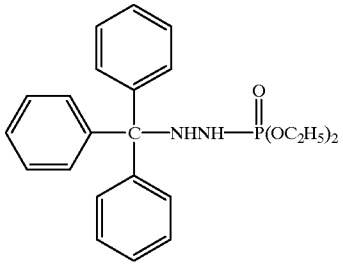
H-120
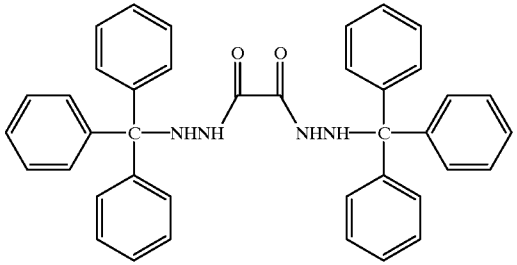
H-121
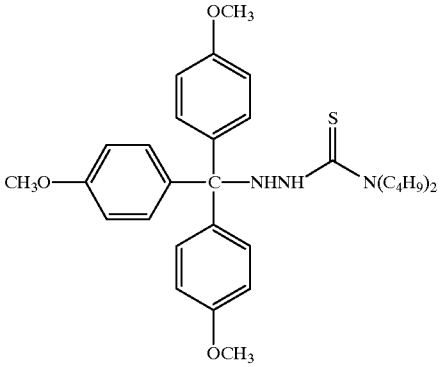

-continued
H-122
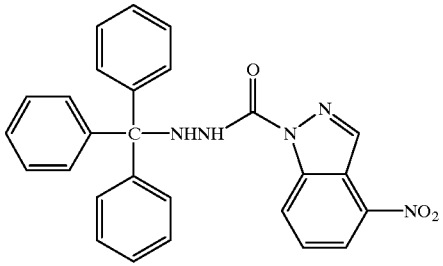
H-123
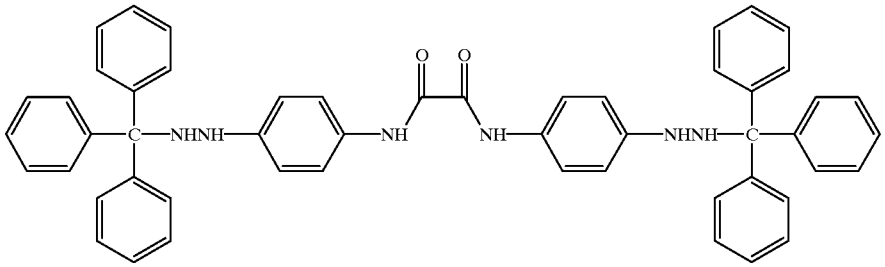
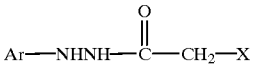
| | Ar = | X = —OH | —SH | —NHCOCF$_3$ | —NHSO$_2$CH$_3$ | —NHSO$_2$ph | —N(CH$_3$)$_2$ |
|---|---|---|---|---|---|---|---|
| H-124 | 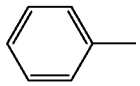 | 124a | 124b | 124c | 124d | 124e | 124f |
| H-125 | 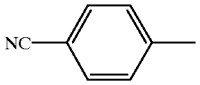 | 125a | 125b | 125c | 125d | 125e | 125f |

-continued
| | | | | | | | |
|---|---|---|---|---|---|---|---|
| H-126 | 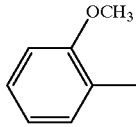 | 126a | 126b | 126c | 126d | 126e | 126f |
| H-127 | 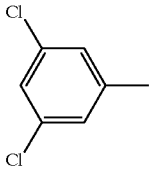 | 127a | 127b | 127c | 127d | 127e | 127f |
| H-128 | 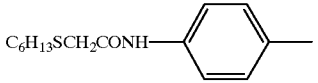 | 128a | 128b | 128c | 128d | 128e | 128f |
| H-129 | 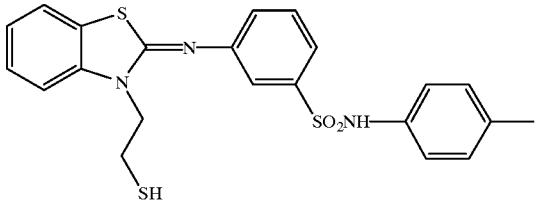 | 129a | 129b | 129c | 129d | 129e | 129f |
| H-130 | 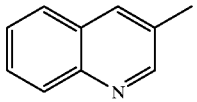 | 130a | 130b | 130c | 130d | 130e | 130f |
| H-131 | 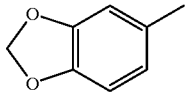 | 131a | 131b | 131c | 131d | 131e | 131f |

-continued
| | | | | | | | |
|---|---|---|---|---|---|---|---|
| H-132 | 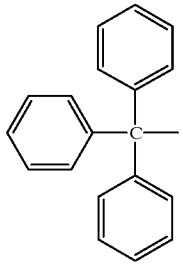 | 132a | 132b | 132c | 132d | 132e | 132f |
| H-133 | 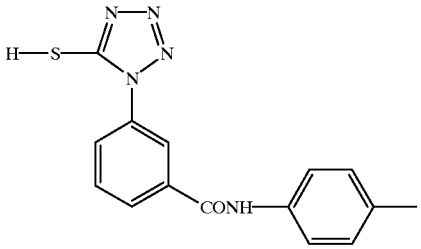 | 133a | 133b | 133c | 133d | 133e | 133f |
| H-134 | 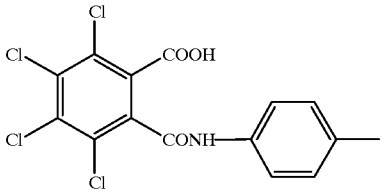 | 134a | 134b | 134c | 134d | 134e | 134f |
| H-135 | 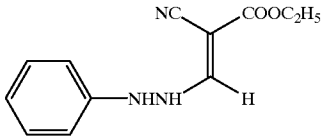 | | | | | | |

-continued
H-136
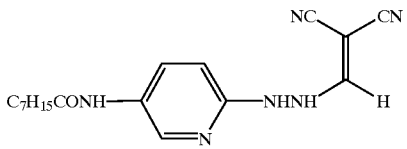
H-137
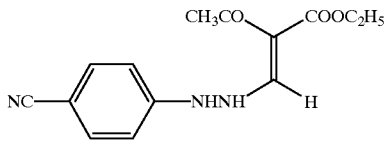
H-138
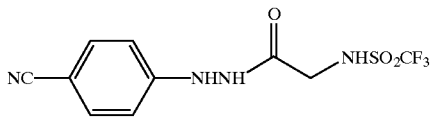
H-139
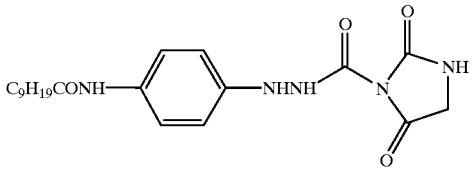
H-140
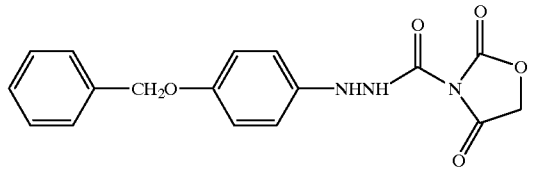
H-141
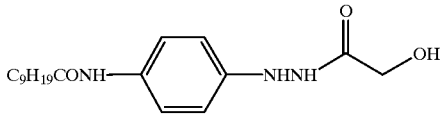

-continued
H-142
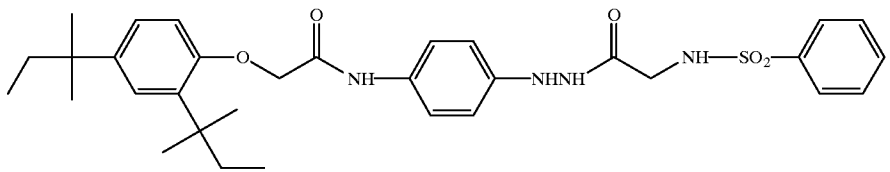
H-143
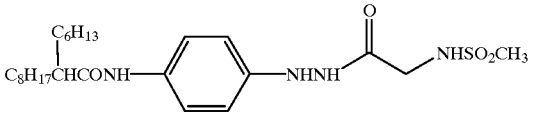
H-144
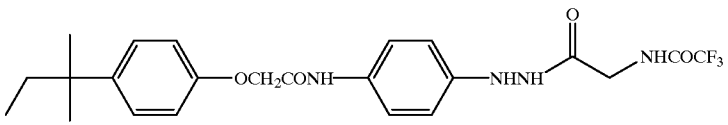
H-145
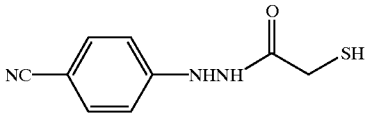

-continued
H-146
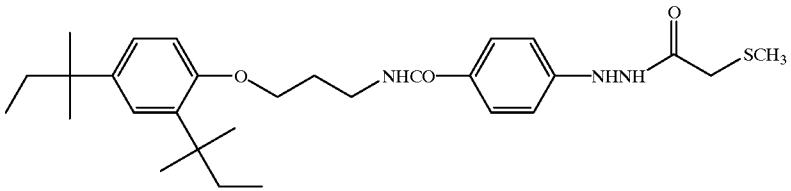
H-147
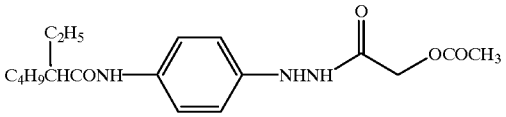
H-148
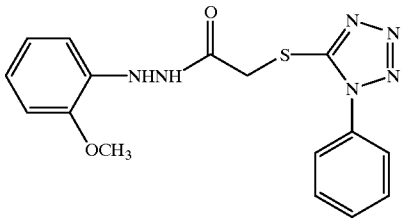

The hydrazine derivatives may be used alone or in admixture of two or more.

In addition to the above-described ones, the following hydrazine derivatives are also preferable for use in the practice of the invention. If desired, any of the following hydrazine derivatives may be used in combination with the hydrazine derivatives of formula (1) or (2). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulas (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulas (1) and (2) in JP-A 289520/1994, more specifically compounds 1-1 to 1-17 and 2-1 described on pages 5 to 7 of the same; the compounds of the chemical formulas [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulas (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulas (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K.K., Mar. 22, 1991, pages 25–34 and Compounds D-2 and D-39 described in JP-A 86354/1987, pages 6–7.

It is noted that with respect to the hydrazine derivatives of formula (2), synthetic examples are found in Japanese Patent Application No. 166628/1997.

In the practice of the invention, the hydrazine derivative is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine derivative may be added to an image forming layer or any other layer on the image forming layer side of a support, and preferably to the image forming layer or a layer disposed adjacent thereto.

The hydrazine derivative is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

Organic Silver Salt

The organic silver salt used herein is a silver salt which is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. The silver-providing substance preferably constitutes about 5 to 70% by weight of the image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benztriazole and derivatives thereof, for example, silver salts of benztriazoles such as silver methylbenztriazole, silver salts of halogenated benztriazoles such as silver 5-chlorobenztriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. In the practice of the invention, grains should preferably have a minor axis or breadth of 0.01 μm to 0.20 μm and a major axis or length of 0.10 μm to 5.0 μm, more preferably a minor axis of 0.01 μm to 0.15 μm and a major axis of 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image of an organic silver salt dispersion obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

For the purpose of obtaining a solid particle dispersion of an organic silver salt having a small particle size and free of agglomeration, the organic silver salt is preferably used as a solid particle dispersion using a dispersant. A solid particle dispersion of the organic silver salt is prepared by mechanically dispersing the organic silver salt in the presence of a dispersant in well-known comminuting means such as a ball mil, vibrating ball mill, planetary ball mill, sand mill, colloid mill, jet mill or roller mill.

In the operation of dispersing the organic silver salt in the presence of dispersants, the dispersants used herein include synthetic anionic polymers such as polyacrylic acid, acrylic acid copolymers, maleic acid copolymers, maleic acid monoester copolymers, and acryloylmethylpropanesulfonic acid copolymers; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in JP-A 350753/1995; well-known anionic, nonionic and cationic surfactants; well-known polymers such as polyvinyl alcohol, polyvinyl pyrrolidone, carboxymethyl cellulose, hydroxypropyl cellulose and hydroxypropylmethyl cellulose; and naturally occurring polymers such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g/m$^2$, more preferably about 1 to 3 g/m$^2$, as expressed by a silver coverage per square meter of the element.

Photosensitive Silver Halide

When the thermographic recording element of the invention is used as a photothermographic recording element, a photosensitive silver halide is used.

A method for forming the photosensitive silver halide is well known in the art. Any of the methods disclosed in *Research Disclosure* No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is preferably up to 0.20 μm, more preferably 0.01 μm to 0.16 μm, most preferably 0.02 μm to 0.14 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-9}$ to $1\times10^{-3}$ mol per mol of silver. Illustrative metal complex structures are those described in JP-A 225449/1995. The cobalt and iron compounds are preferably hexacyano metal complexes while illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P-Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the preformed photosensitive silver halide at any timing during preparation of an organic silver salt. Any desired mixing method may be used insofar as the benefits of the invention are fully achievable.

One of the preferred methods for preparing the silver halide is a so-called halidation method of partially halogenating the silver of an organic silver salt with an organic or inorganic halide. Any of organic halides which can react with organic silver salts to form silver halides may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form silver halides may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Reducing Agent

The photothermographic element according to the preferred embodiment of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For thermographic recording elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, amine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl) methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For thermographic recording elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl) aryldicarboxyimides such as (N,N-dimethylaminomethyl) phthalimide and N,N-(dimethylaminomethyl)naphthalene-2,3-dicarboxyimide; blocked pyrazoles, isothiuronium derivatives and certain photobleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonylbenzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine, and 2,3-dihydrophthalazine; combinations of phthalazine or derivatives thereof with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

Binder

The image forming layer used herein is usually based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

At least one layer of the image-forming layers used herein may be an image forming layer wherein a polymer latex constitutes more than 50% by weight of the entire binder. This image forming layer is sometimes referred to as "inventive image-forming layer" and the polymer latex used as the binder therefor is referred to as "inventive polymer latex," hereinafter. The term "polymer latex" used herein is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

Polymers of polymer latexes used as the binder according to the invention have glass transition temperatures (Tg) whose preferred range differs among the protective layer, the back layer and the image-forming layer. For the image forming layer, polymers having a Tg of up to 40° C., especially −30° C. to 40° C. are preferred in order to promote the diffusion of photographically effective addenda upon heat development. For the protective layer and the back layer which are to come in contact with various equipment, polymers having a Tg of 25° C. to 70° C. are especially preferred.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the inventive polymer latex include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the inventive polymer latex should preferably have an equilibrium moisture content at 25° C. and RH 60% of up to 2% by weight, more preferably up to 1% by weight. The lower limit of equilibrium moisture content is not critical although it is preferably 0.01% by weight, more preferably 0.03% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the image-forming layer of the thermographic recording element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dainippon Ink & Chemicals K.K.) and WD-size and WMS (Eastman Chemical Products, Inc.). Exemplary polyurethane resins are HYDRAN AP10, 20, 30 and 40 (Dainippon Ink & Chemicals K.K.). Exemplary rubbery resins are LACSTAR 7310K, 3307B, 4700H and 7132C (Dainippon Ink & Chemicals K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Chemical K.K.). These polymers may be used alone or in admixture of two or more.

In the inventive image-forming layer, the polymer latex described above is preferably used in an amount of at least 50% by weight, especially at least 70% by weight, of the entire binder. In the inventive image-forming layer, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30% by weight of the entire binder in the image-forming layer.

The inventive image-forming layer is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide or ethyl acetate. Beside water, exemplary solvent compositions include a 90/10 mixture of water/methanol, a 70/30 mixture of water/methanol, a 90/10 mixture of water/ethanol, a 90/10 mixture of water/isopropanol, a 95/5 mixture of water/dimethylformamide, a 80/15/5 mixture of water/methanol/dimethylformamide, and a 90/5/5 mixture of water/methanol/dimethylformamide, all expressed in a weight ratio.

The method described in U.S. Pat. No. 5,496,695 is also useful.

In the inventive image-forming layer, the total amount of binder is preferably 0.2 to 30 g/m$^2$, more preferably 1 to 15 g/m$^2$. To the image forming layer, crosslinking agents for crosslinking, surfactants for ease of application, and other addenda may be added.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in *Research Disclosure*, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for He-Ne laser, red semiconductor laser and LED light sources.

It is also advantageous to spectrally sensitize silver halide grains for semiconductor laser light sources in the wavelength range of 750 to 1,400 nm. Such spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole or imidazole nucleus. Preferred examples of the useful merocyanine dye contain an acidic nucleus such as a thiohydantoin, rhodanine, oxazolidinedione, thiazolinedione, barbituric acid, thiazolinone, malononitrile or pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in *Research Disclosure*, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, during the silver halide grain forming step and/or a stage prior to the desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $1\times10^{-9}$ mol to $1\times10^{-3}$ mol, more preferably lx10-$^{8}$ mol to $1\times10^{-4}$ mol per mol of silver coated.

Still further, the thermographic recording element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the recording element, preferably to a layer on the same side as the image forming layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $1\times10^{-6}$ to 2 mol, more preferably $1\times10^{-3}$ to 0.5 mol per mol of silver.

In the element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the image forming layer (emulsion layer) in amounts of 0.001 to 1.0 mol, more preferably 0.01 to 0.3 mol per mol of silver.

In the thermographic recording element of the invention, a nucleation promoter may be added for promoting the action of the nucleating agent. The nucleation promoter used herein includes amine derivatives, onium salts, disulfide derivatives, hydroxymethyl derivatives, hydroxamic acid derivatives, acylhydrazide derivatives, acrylonitrile derivatives and hydrogen donors. Examples of the nucleation promoter include the compounds described in JP-A 77783/1995, page 48, lines 2–37, more specifically Compounds A-1 to A-73 described on pages 49–58 of the same; the compounds of the chemical formulas [21], [22] and [23] described in JP-A 84331/1995, more specifically the compounds described on pages 6–8 of the same; the compounds of the general formulas [Na] and [Nb] described in JP-A 104426/1995, more specifically Compounds Na-1 to Na-22 and Nb-1 to Nb-12 described on pages 16–20 of the same; the compounds of the general formulas (1), (2), (3), (4), (5), (6) and (7) described in Japanese Patent Application No. 37817/1995, more specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 described therein; and the nucleation promoters described in Japanese Patent Application No. 70908/1996.

The nucleation promoter may be used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

Also, a well-known emulsifying dispersion method is used for dissolving the nucleation promoter with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the nucleation promoter in powder form in water in a ball mill, colloidal mill or ultrasonic mixer.

The nucleation promoter may be added to an image forming layer or any other binder layer on the image forming layer side of the support, and preferably to the image forming layer or a binder layer disposed adjacent thereto.

The nucleation promoter is preferably used in an amount of $1\times10^{-6}$ mol to $2\times10^{-1}$ mol, more preferably $1\times10^{-5}$ mol to $2\times10^{-2}$ mol, most preferably $2\times10^{-5}$ to $1\times10^{-2}$ mol per mol of silver.

In the image forming layer, polyhydric alcohols (e.g., glycerols and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

Protective Layer

A surface protective layer may be provided in the thermographic recording element of the present invention for the purpose of preventing sticking of the image forming layer.

The surface protective layer is based on a binder which may be any desired polymer, although the layer preferably contains 100 mg/m$^2$ to 5 g/m$^2$ of a polymer having a carboxylic acid residue. The polymers having carboxylic acid residues include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably 10 mmol to 1.4 mol per 100 g of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the image forming layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion layer side surface may have any degree of matte insofar as no star dust failures occur although a Bekk smoothness of 200 to 10,000 seconds, especially 300 to 10,000 seconds is preferred.

The thermographic photographic emulsion used in the thermographic recording element according to the one preferred embodiment of the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second layer or both the layers contain other components. Also envisioned herein is a two-layer construction consisting of a single emulsion layer containing all the components and a protective topcoat. In the case of multicolor sensitive photothermographic material, a combination of such two layers may be employed for each color. Also a single layer may contain all necessary components as described in U.S. Pat. No. 4,708,928. In the case of multidye, multi-color sensitive photothermographic material, emulsion (or photosensitive) layers are distinctly supported by providing a functional or non-functional barrier layer therebetween as described in U.S. Pat. No. 4,460,681.

In the image forming layer, a variety of dyes and pigments may be used from the standpoints of improving tone and preventing irradiation. Any desired dyes and pigments may be used in the invention. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 $\mu$g to 1 g per square meter of the recording element.

In the practice of the invention, an antihalation layer may be disposed on the side of the image forming layer remote from the light source. The antihalation layer preferably has a maximum absorbance of 0.1 to 2 in the desired wavelength range, more preferably an absorbance of 0.2 to 1.5 at the exposure wavelength, and an absorbance of 0.001 to less than 0.2 in the visible region after processing, and is also preferably a layer having an optical density of 0.001 to less than 0.15.

Where an antihalation dye is used in the invention, it may be selected from various compounds insofar as it has the desired absorption in the wavelength range, is sufficiently low absorptive in the visible region after processing, and provides the antihalation layer with the preferred absorbance profile. Exemplary antihalation dyes are given below though the dyes are not limited thereto. Useful dyes which are used alone are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. It is further preferable in the practice of the invention to use a dye which will decolorize during processing. Illustrative, non-limiting, examples of decolorizable dyes are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In one preferred embodiment, the thermographic recording element of the invention is a one-side recording element having at least one image forming layer on one side and a back layer on the other side of the support.

In the practice of the invention, a matte agent may be added to the recording element for improving transportation. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coacervation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 1,200 seconds, more preferably 50 to 700 seconds.

In the recording element of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3. Examples of the antihalation dye used in the back layer are the same as previously described for the antihalation layer.

A backside resistive heating layer as described in U.S. Pat. Nos. 4,460,681 and 4,374,921 may be used in a photographic thermographic image recording system according to the present invention.

According to the invention, a hardener may be used in various layers including an image forming layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Examples of the solvent used herein are described in "New Solvent Pocket Book," Ohm K.K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

Support

According to the invention, the thermographic emulsion may be coated on a variety of supports. Typical supports include polyester film, subbed polyester film, poly(ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent.

The thermographic recording element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the thermographic recording element of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic photographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the thermographic recording element of the invention, there may be contained additional layers, for example, a dye accepting layer for accepting a mobile dye image, an opacifying layer when reflection printing is desired, a protective topcoat layer, and a primer layer well known in the photothermographic art. The recording material of the invention is preferably such that only a single sheet of the recording material can form an image. That is, it is preferred that a functional layer necessary to form an image such as an image receiving layer does not constitute a separate member.

The thermographic recording element of the invention may be developed by any desired method although it is generally developed by heating after imagewise exposure. The preferred developing temperature is about 80 to 250° C., more preferably 100 to 140° C. The preferred developing time is about 1 to 180 seconds, more preferably about 10 to 90 seconds.

One effective means for preventing the thermographic recording element from experiencing process variations due to dimensional changes during heat development is a method (known as a multi-stage heating method) of heating the element at a temperature of 80° C. to less than 115° C. (preferably up to 113° C.) for at least 5 seconds so that no images are developed and thereafter, heating at a temperature of at least 110° C. (preferably up to 130° C.) for heat development to form images.

Any desired technique may be used for the exposure of the thermographic recording element of the invention. The preferred light source for exposure is a laser, for example, a gas laser, YAG laser, dye laser or semiconductor laser. A semiconductor laser combined with a second harmonic generating device is also useful.

Developing Apparatus

Referring to FIG. 1, there is schematically illustrated one exemplary heat developing apparatus for use in the processing of the thermographic recording element according to the invention. FIG. 1 is a side elevation of the heat developing apparatus which includes a cylindrical heat drum 2 having a halogen lamp 1 received therein as a heating means, and an endless belt 4 trained around a plurality of feed rollers 3 so that a portion of the belt 4 is in close contact with the drum 2. A length of photothermographic element 5 is fed and guided by pairs of guide rollers to between the heat drum 2 and the belt 4. The element 5 is fed forward while it is clamped between the heat drum 2 and the belt 4. While the element 5 is fed forward, it is heated to the developing temperature whereby it is heat developed. In the heat developing apparatus of the drum type, the luminous intensity distribution of the lamp is optimized so that the temperature in the transverse direction may be precisely controlled to the desired level within ±1° C.

The element 5 exits at an exit 6 from between the heat drum 2 and the belt 4 where the element is released from bending by the circumferential surface of the heat drum 2. A correcting guide plate 7 is disposed in the vicinity of the exit 6 for correcting the element 5 into a planar shape. A zone surrounding the guide plate 7 is temperature adjusted so that the temperature of the element 5 may not lower below the predetermined level (e.g., 90° C.).

Disposed downstream of the exit 6 are a pair of feed rollers 8. A pair of planar guide plates 9 are disposed downstream of and adjacent to the feed rollers 8 for guiding the element 5 while keeping it planar. Another pair of feed rollers 10 are disposed downstream of and adjacent to the guide plates 9. The planar guide plates 9 have such a length that the element 5 is fully cooled, typically below 30° C., while it passes over the plates 9. The means associated with the guide plates 9 for cooling the element 5 are cooling fans 11.

Although the belt conveyor type heat developing apparatus has been described, the invention is not limited thereto. Use may be made of heat developing apparatus of varying constructions such as disclosed in JP-A 13294/1995. In the case of a multi-stage heating mode which is preferably used in the practice of the invention, two or more heat sources having different heating temperatures are disposed in the illustrated apparatus so that the element may be continuously heated to different temperatures.

EXAMPLE

Examples of the invention are given below by way of illustration and not by way of limitation.

Example 1

Silver Halide Emulsion A

In 700 ml of water were dissolved 11 g of phthalated gelatin, 30 mg of potassium bromide, and 10 mg of sodium benzenethiosulfonate. The solution was adjusted to pH 5.0 at a temperature of 55° C. To the solution, 159 ml of an aqueous solution containing 18.6 g of silver nitrate and an aqueous solution containing 1 mol/liter of potassium bromide were added over 6½ minutes by the controlled double jet method while maintaining the solution at pAg 7.7. Then, 476 ml of an aqueous solution containing 55.5 g of silver nitrate and an aqueous halide solution containing 1 mol/liter of potassium bromide were added over 28½ minutes by the controlled double jet method while maintaining the solution at pAg 7.7. Thereafter, the pH of the solution was lowered to cause flocculation and sedimentation for desalting. Further, 0.17 g of Compound A and 23.7 g of deionized gelatin (calcium content below 20 ppm) were added to the solution, which was adjusted to pH 5.9 and pAg 8.0. There were obtained cubic grains of silver halide having a mean grain size of 0.11 $\mu$m, a coefficient of variation of the projected area of 8%, and a (100) face proportion of 93%.

The thus obtained silver halide grains were heated at 60° C., to which 76 $\mu$mol of sodium benzenethiosulfonate was added per mol of silver. After 3 minutes, 154 $\mu$mol of sodium thiosulfate was added and the emulsion was ripened for 100 minutes.

Thereafter, the emulsion was maintained at 40° C., and with stirring, $6.4\times10^{-4}$ mol of Sensitizing Dye A and $6.4\times10^{-3}$ mol of Compound B were added per mol of silver halide. After 20 minutes, the emulsion was quenched to 30° C., completing the preparation of a silver halide emulsion A.

Sensitizing Dye A

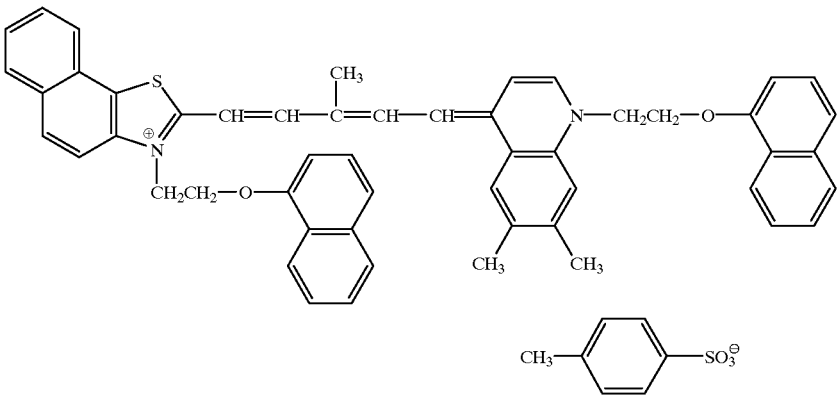

Compound A

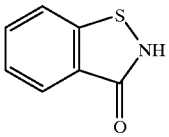

Compound B

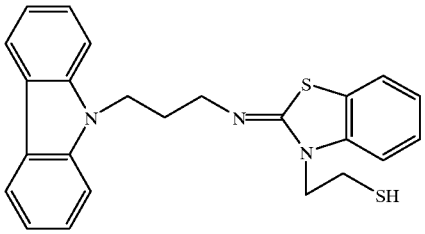

Preparation of Organic Acid Silver Dispersion

Organic Acid Silver A

While a mixture of 4.4 g of arachic acid, 39.4 g of behenic acid, and 770 ml of distilled water was stirred at 85° C., 103 ml of 1N NaOH aqueous solution was added over 60 minutes. The solution was reacted for 240 minutes, then cooled to 75° C. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 $\mu$S/cm. The thus obtained solids were handled as a wet cake without drying. To 100 g as dry solids of the wet cake, 5 g of polyvinyl alcohol PVA-205 (Kurare K.K.) and water were added to a total weight of 500 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/cm$^2$. There was obtained an organic acid silver dispersion A. The organic acid silver grains in this dispersion were acicular grains having a mean minor axis (or breadth) of 0.04 $\mu$m, a mean major axis (or length) of 0.8 $\mu$m, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Solid Particle Dispersion of 1,1-bis(2-hydroxy-3,5-dimethylphenyl)-3,5,5-trimethylhexane To 20 g of 1,1-bis(2-hydroxy-3,5-dimethylphenyl)-3,5,5-trimethylhexane were added 3.0 g of modified polyvinyl alcohol MP-203 (Kurare K.K.) and 77 ml of water. They were thoroughly agitated to form a slurry, which was allowed to stand for 3 hours. A vessel was charged with the slurry together with 360 g of zirconia beads having a mean diameter of 0.5 mm. A dispersing machine 1/4G Sand Grinder Mill (Imex K.K.) was operated for 3 hours for dispersion, obtaining a solid particle dispersion of the reducing agent in which particles with a diameter of 0.3 to 1.0 $\mu$m accounted for 80% by weight.

Solid Particle Dispersion of Tribromomethylphenylsulfone

To 30 g of tribromomethylphenylsulfone were added 0.5 g of hydroxypropylmethyl cellulose, 0.5 g of Compound C, and 88.5 g of water. They were thoroughly agitated to form a slurry, which was allowed to stand for 3 hours. Following the steps used in the preparation of the solid particle dispersion of the reducing agent, a solid particle dispersion of the antifoggant was prepared in which particles with a diameter of 0.3 to 1.0 $\mu$m accounted for 80% by weight.

Solid Particle Dispersion of Nucleating Agent and Hydrazine Derivative

To 89 g of water were added 10 g of a nucleating agent and/or hydrazine derivative (shown in Table 32), 0.5 g of hydroxypropylmethyl cellulose, and 0.5 g of Compound C. They were thoroughly agitated to form a slurry, which was allowed to stand for 3 hours. Following the steps used in the preparation of the solid particle dispersion of the reducing agent, a solid particle dispersion of the nucleating agent and/or hydrazine derivative was prepared in which particles with a diameter of 0.3 to 1.0 μm accounted for 80% by weight.

Compound C

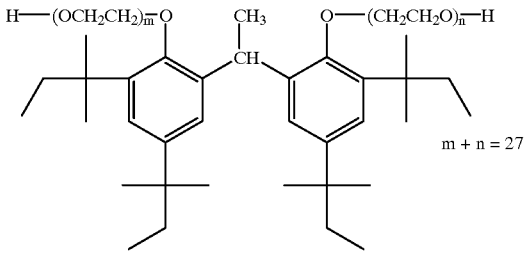

Emulsion Layer Coating Solution

To the above-prepared organic acid silver microcrystalline dispersion A (corresponding to 1 mol of silver) were added the above-prepared silver halide emulsion A and the binder and addenda described below. Water was added thereto to form an emulsion layer coating solution.

| | |
|---|---|
| Binder: LACSTAR 3307B (Dai-Nippon Ink & Chemicals K.K., SBR latex, Tg 17° C.) | as solids 470 g |
| 1,1-bis (2-hydroxy-3,5-dimethylphenyl)-3,5,5-trimethylhexane | as solids 110 g |
| Tribromomethylphenylsulfone | as solids 25 g |
| Sodium benzenethiosulfonate | 0.25 g |
| Polyvinyl alcohol MP-203 (Kurare K.K.) | 46 g |
| Compound F | 0.12 mol |
| Solid dispersion of nucleating agent and hydrazine derivative | see Table 32 |
| Dyestuff A | 0.62 g |
| Silver halide emulsion A | as Ag 0.05 mol |

Dyestuff A

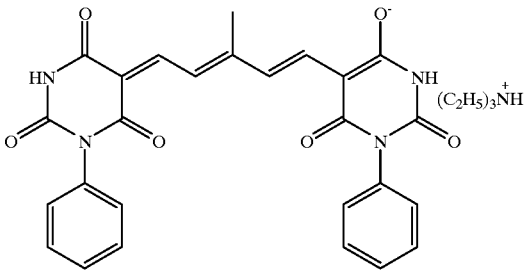

Compound F

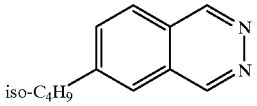

Emulsion Surface Protective Layer Coating Solution

A surface protective layer coating solution was prepared by adding 3.75 g of $H_2O$ to 109 g of a polymer latex having a solids content of 27.5% (methyl methacrylate/styrene/2-ethylhexyl acrylate/2-hydroxyethyl methacrylate/acrylic acid=59/9/26/5/1 copolymer, Tg 55° C.), then adding 4.5 g of benzyl alcohol as a film-forming aid, 0.45 g of Compound D, 0.125 g of Compound E, 0.0125 mol of Compound G, and 0.225 g of polyvinyl alcohol PVA-217 (Kurare K.K.), and diluting with water to a total weight of 150 g.

Compound D

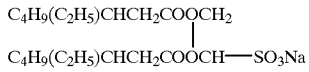

Compound E

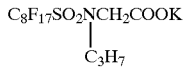

Compound G

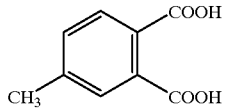

PET supports with Back and Undercoat Layers (1) Support

Using terephthalic acid and ethylene glycol, a polyethylene terephthalate (PET) having an intrinsic viscosity of 0.66 as measured in a phenol/tetrachloroethane 6/4 (weight ratio) mixture at 25° C. was prepared in a conventional manner. After the PET was pelletized and dried at 130° C. for 4 hours, it was melted at 300° C., extruded through a T-shaped die, and quenched to form an unstretched film having a thickness sufficient to give a thickness of 120 μm after thermosetting.

The film was longitudinally stretched by a factor of 3.3 by means of rollers rotating at different circumferential speeds and then transversely stretched by a factor of 4.5 by means of a tenter. The temperatures in these stretching steps were 110° C. and 130° C., respectively. Thereafter, the film was thermoset at 240° C. for 20 seconds and then transversely relaxed 4% at the same temperature. Thereafter, with the chuck of the tenter being slit and the opposite edges being knurled, the film was taken up under a tension of 4.8 kg/cm$^2$. In this way, a film of 2.4 m wide, 3,500 m long and 120 μm thick was obtained in a roll form.

| | |
|---|---|
| (2) Undercoat layer (a) | |
| Polymer latex-1 (styrene/butadiene/hydroxyethyl methacrylate/divinyl benzene = 67/30/2.5/0.5 wt%) | 160 mg/m$^2$ |
| 2,4-dichloro-6-hydroxy-s-triazine | 4 mg/m$^2$ |
| Matte agent (polystyrene, mean particle size 2.4 μm) | 3 mg/m$^2$ |
| (3) Undercoat layer (b) | |
| Alkali-treated gelatin ($Ca^{2+}$ content 30 ppm, jelly strength 230 g) | 50 mg/m$^2$ |
| Dyestuff B | coverage to give an optical density of 0.7 at 780 nm |

Dyestuff B

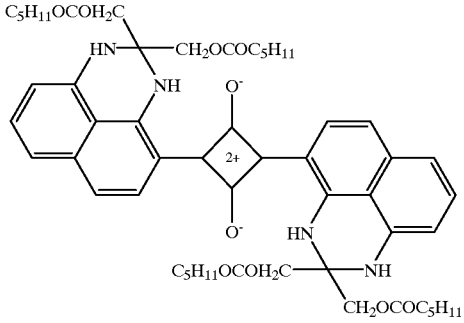

| (4) Conductive layer | |
|---|---|
| Jurimer ET410 (Nippon Junyaku K.K.) | 38 mg/m$^2$ |
| $SnO_2$/Sb (9/1 weight ratio, mean particle size 0.25 $\mu$m) | 120 mg/m$^2$ |
| Matte agent (polymethyl methacrylate, mean particle size 5 $\mu$m) | 7 mg/m$^2$ |
| Melamine resin | 13 mg/m$^2$ |
| (5) Protective layer | |
| Chemipearl S-120 (Mitsui Chemical K.K.) | 500 mg/m$^2$ |
| Snowtex C (Nissan Chemical K.K.) | 40 mg/m$^2$ |
| Denacol EX-614B (Nagase Chemicals K.K.) | 30 mg/m$^2$ |

The undercoat layer (a) and the undercoat layer (b) were successively coated on both sides of the PET support and respectively dried at 180° C. for 4 minutes. Then, the conductive layer and the protective layer were successively coated on one side of the support where undercoat layers (a) and (b) had been coated, and respectively dried at 180° C. for 4 minutes, completing the PET support having the back and undercoat layers.

The thus prepared PET support having back and undercoat layers was passed through a heat treating zone having an overall length of 200 m and set at 200° C. at a feed speed of 20 m/min under a tension of 3 kg/m$^2$. Thereafter, the support was passed through a zone set at 40° C. for 15 seconds and taken up into a roll under a tension of 10 kg/cm$^2$.

Thermographic Recording Element

The emulsion layer coating solution was applied onto the undercoat side of the PET support having the back and undercoat layers to a silver coverage of 1.6 g/m$^2$. The emulsion surface protective layer coating solution was applied thereon so that the coverage of the polymer latex (as solids) was 2.0 g/m$^2$, obtaining photothermographic element samples.

Processing

The coated samples were exposed to xenon flash light for an emission time of $10^{-6}$ sec through an interference filter having a peak at 780 nm and a step wedge.

The heat developing apparatus shown in FIG. 1 was modified by arranging two heat sources in the same structure as in the heat developing apparatus shown in FIG. 3 of JP-A 13294/1995, so that the film could be heated in two consecutive stages. Using this apparatus, the exposed samples were heat developed. Specifically, they were first heated at 105° C. for 10 seconds (conditions under which no images were developed), then at 119° C. for 15 seconds.

Photographic Properties

The resulting images were measured by a Macbeth TD904 densitometer (visible density). The contrast was expressed by the gradient (γ) of a straight line connecting density points 0.1 and 3.0 in a graph wherein the logarithm of the exposure is on the abscissa. Gamma values of at least 10 are practically acceptable, with gamma values of at least 15 being preferable.

Separately, the exposed samples were heat developed by first heating at 105° C. for 10 seconds (conditions under which no images were developed), then at 121° C. (that is, the standard condition+20° C.) for 15 seconds. The resulting images were measured for fog by a Macbeth TD904 densitometer (visible density). Fog values of 0.2 or lower are practically acceptable, with fog values of 0.15 or lower being preferable.

A change of Dmax associated with a drop of developing temperature was calculated according to the following formula:

$$\Delta Dmax = Dmax(1) - Dmax(2)$$

wherein Dmax(1) is the Dmax of the sample developed under standard condition 1 where the sample was heated at 105° C. for 10 seconds (conditions under which no images were developed), then at 119° C. for 15 seconds; and Dmax(2) is the Dmax of the sample developed under condition 2 where the sample was heated at 105° C. for 10 seconds (conditions under which no images were developed), then at 116° C. for 15 seconds. ΔDmax values of 0.5 or lower are practically acceptable, with ΔDmax values of 0.3 or lower being preferable.

The results are shown in Table 32. It is noted that Compounds N-1 and N-2 used as comparative nucleating agents are as shown below and correspond to Compound CN-08 described in U.S. Pat. No. 5,545,515 and Compound HET-01 described in U.S. Pat. No. 5,635,339, respectively.

Compound N-1

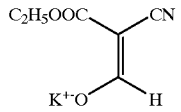

Compound N-2

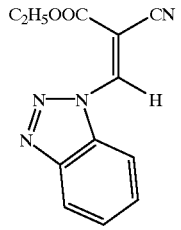

TABLE 32

| Sample | Nucleating agent Amount | | Hydrazine derivative Amount | | Photographic properties | | | |
|---|---|---|---|---|---|---|---|---|
| No. | No. | (mmol/mol Ag) | No. | (mmol/mol Ag) | γ | Fog | Δ dmax | Remarks |
| 1 | N-1 | 30 | — | — | 13 | 0.12 | 1.2 | Comparison |
| 2 | N-2 | 30 | — | — | 15 | 0.13 | 1.1 | Comparison |
| 3 | 28 | 30 | — | — | 16 | 0.11 | 0.9 | Comparison |
| 4 | 102 | 30 | — | — | 15 | 0.12 | 0.8 | Comparison |
| 5 | — | — | H-54a | 30 | 15 | 0.62 | 0.3 | Comparison |
| 6 | — | — | H-125a | 30 | 16 | 0.74 | 0.4 | Comparison |
| 7 | N-1 | 15 | H-54a | 15 | 12 | 0.65 | 1.2 | Comparison |
| 8 | N-2 | 15 | H-54a | 15 | 13 | 0.55 | 1.1 | Comparison |
| 9 | N-1 | 15 | H-125a | 15 | 13 | 0.79 | 0.8 | Comparison |
| 10 | N-2 | 15 | H-125a | 15 | 12 | 0.59 | 0.9 | Comparison |
| 11 | 28 | 15 | H-54a | 15 | 14 | 0.18 | 0.4 | Invention |
| 12 | 102 | 15 | H-54a | 15 | 13 | 0.19 | 0.4 | Invention |
| 13 | 3 | 15 | H-125a | 15 | 17 | 0.11 | 0.1 | Invention |
| 14 | 28 | 15 | H-125a | 15 | 18 | 0.11 | 0.2 | Invention |
| 15 | 32 | 15 | H-125a | 15 | 17 | 0.13 | 0.2 | Invention |
| 16 | 43 | 15 | H-125a | 15 | 16 | 0.13 | 0.1 | Invention |
| 17 | 60 | 15 | H-125a | 15 | 16 | 0.11 | 0.3 | Invention |
| 18 | 101 | 15 | H-125a | 15 | 18 | 0.10 | 0.2 | Invention |
| 19 | 102 | 15 | H-125a | 15 | 18 | 0.10 | 0.1 | Invention |
| 20 | 28 | 15 | H-54s | 15 | 14 | 0.17 | 0.4 | Invention |
| 21 | 28 | 15 | H-56m | 15 | 16 | 0.13 | 0.3 | Invention |
| 22 | 28 | 15 | H-125d | 15 | 17 | 0.13 | 0.3 | Invention |
| 23 | 28 | 15 | H-127e | 15 | 15 | 0.12 | 0.2 | Invention |
| 24 | 28 | 15 | H-127f | 15 | 16 | 0.12 | 0.3 | Invention |
| 25 | 28 | 15 | H-138 | 15 | 18 | 0.13 | 0.3 | Invention |
| 26 | 28 | 15 | H-141 | 15 | 18 | 0.11 | 0.2 | Invention |
| 27 | 28 | 15 | H-142 | 15 | 17 | 0.11 | 0.2 | Invention |
| 28 | 28 | 15 | H-143 | 15 | 16 | 0.12 | 0.1 | Invention |
| 29 | 28 | 15 | H-144 | 15 | 17 | 0.11 | 0.3 | Invention |
| 30 | 28 | 15 | H-145 | 15 | 14 | 0.15 | 0.3 | Invention |

It is seen from Table 32 that thermographic recording elements exhibiting an ultrahigh contrast, a minimized drop of Dmax associated with a lowering of developing temperature, and a minimized fog increase associated with a rise of developing temperature are obtained only when a nucleating agent within the scope of the invention is used in combination with a hydrazine derivative.

There have been described thermographic recording elements exhibiting a high contrast and experiencing a minimized change of photographic properties with varying development temperature.

Japanese Patent Application No. 145055/1998 is incorporated herein by reference.

Reasonable modifications and variations are possible from the foregoing disclosure without departing from either the spirit or scope of the present invention as defined by the claims.

What is claimed is:

1. A thermographic recording element having at least one image forming layer and comprising an organic silver salt, a photosensitive silver halide, a reducing agent, a hydrazine derivative, and at least one compound selected from compounds of the following formulas (A) and (B):

formula (A)

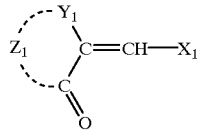

wherein $Z_1$ is a group of non-metallic atoms completing a 5- to 7-membered cyclic structure, $Y_1$ is —C(=O)— or —$SO_2$—, and $X_1$ is a hydroxyl group or salt thereof, alkoxy group, aryloxy group, heterocyclic oxy group, mercapto group or salt thereof, alkylthio group, arylthio group, heterocyclic thio group, acylamino group, sulfonamide group or heterocyclic group, the compound of formula (A) having at least 6 carbon atoms in total, formula (B)

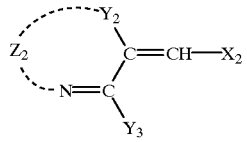

wherein $Z_2$ is a group of non-metallic atoms completing a 5- to 7-membered cyclic structure, $Y_2$ is —C(=O)— or —$SO_2$—, $X_2$ is a hydroxyl group or salt thereof, alkoxy group, aryloxy group, heterocyclic oxy group, mercapto group or salt thereof, alkylthio group, arylthio group, heterocyclic thio group, acylamino group, sulfonamide group or heterocyclic group, and $Y_3$ is hydrogen or an optionally substituted substituent selected from the group consisting of alkyl, aryl, heterocyclic, cyano, acyl, alkoxycarbonyl, aryloxycarbonyl, carbamoyl, amino, alkylamino, arylamino, heterocyclicamino, acylamino, sulfonamide, ureido, thioureido, imide, alkoxy, aryloxy, alkylthio, arylthio, and hetrocyclicthio, the compound of formula (B) having at least 12 carbon atoms in total.

2. The photothermographic element of claim 1 wherein $Z_1$ in formula (A) has at least 3 carbon atoms in total, and $Z_2$ and $Y_3$ in formula (B) have at least 8 carbon atoms in total.

3. The photothermographic element of claim 2 wherein in formula (A), $Y_1$ is a carbonyl group and $Z_1$ is a group of atoms capable of forming a 5- or 6-membered cyclic structure, and in formula (B), $Y_2$ is a carbonyl group and $Z_2$ is an oxygen or nitrogen atom capable of forming a 5-membered cyclic structure.

4. The photothermographic element of claim 1 wherein said at least one compound is a compound of formula (A) wherein $Y_1$ is a carbonyl group and $Z_1$ forms an indanedione, pyrrolidinedione, or pyrazolidinedione ring with $—Y_1—C(=CH—X_1)—C(=O)—$.

5. The photothermographic element of claim 4 wherein in formula (A), $X_1$ represents a hydroxy group or a salt thereof, an alkoxy group, a mercapto group or a salt thereof, an alkylthio group, or a heterocyclic group.

6. The photothermographic element of claim 5 wherein in formula (A), $Z_1$ represents a group of atoms capable of forming a pyrazolidinedione ring.

7. The photothermographic element of claim 1 wherein said hydrazine derivative has the following formula (2):

$$R^{11}—NHNH—CO—C(R^{22})(R^{33})—X \quad (2)$$

wherein $R^{11}$ represents an aromatic group; $R^{22}$ and $R^{33}$ independently represent hydrogen or a substituent; X represents —OH, —OR, —OCOR, —SH, —SR, —NHCOR, $—NHSO_2R$, $—NHCON(R_N')R_N'$, $—NHSO_2N(R_N)R_N'$, $—NHCO_2R$, $—NHCOCON(R_N)R_N'$. $—NHCOCO_2R$, $—NHCON(R_N)SO_2R$ or $—N(R_N)R_N'$; R represents an alkyl, aryl or heterocyclic group; and $R_N$ and $R_N'$ independently represent hydrogen or an alkyl, aryl or heterocyclic group.

8. The photothermographic element of claim 7 wherein in formula (2), X represents —OH, —OR, —NHCOR, $—NHSO_2R$ or $—N(R_N)R_N'$.

9. The photothermographic element of claim 1, wherein $Z_1$ is a group of atoms selected from the group consisting of carbon, oxygen, sulfur, nitrogen and hydrogen wherein several atoms in said group are coupled through valence bonds or double bonds to form a 5- to 7-membered cyclic structure with $—Y_1—C(=CH—X_1)—C(=O)—$.

10. The photothermographic element of claim 1, wherein $Z_2$ is a group of atoms selected from the group consisting of carbon, oxygen, sulfur, nitrogen and hydrogen wherein several atoms in said group are coupled through valence bonds or double bonds to form a 5- to 7-membered cyclic structure with $—Y_2—C(=CH—X_2)—C(Y_3)=N—$.

11. The photothermographic element of claim 1, wherein $Z_1$ is substituted with a member selected from the group consisting of a halogen atom, an alkyl group, an alkenyl group, an alkynyl group, an aryl group, a heterocyclic group, a heterocyclic group containing quaternized nitrogen atom, an acyl group, an alkoxycarbonyl group, an aryloxycarbonyl group, a carbamoyl group, a carboxy group or salt thereof, a sulfonylcarbamoyl group, an acylcarbamoyl group, a sulfamoylcarbamoyl group, a carbazoyl group, an oxalyl grop, an oxamoyl group, a cyano group, a thiocarbamoyl group, a hydroxy group, an alkoxy group, an aryloxy group, a heterocyclic oxy group, an acyloxy group, an amino group, an N-substituted nitrogenous heterocylic group, an acylamino group, a sulfonamide group, a ureido group, a thioureido group, an imide group, a carbonylamino group, a sulfamoylamino group, a semicarbazido group, a thiosemicarbazido group, a hydrazino group, a quaternary amonio group, an oxamoylamino group, a sulfonylureido group, an acylureido group, an acylsulfamoylamino group, a nitro group, a mercapto group, a thio group, a sulfonyl group, a sulfinyl group, a sulfo group or salt thereof, a sulfamoyl group, an acylsulfamoyl group, a sulfonylsulfamoyl group or a salt thereof, a group containing a phosphoramide or phosphate structure, a silyl group and a stannyl group.

12. The photothermographic element of claim 1, wherein $Z_2$ is substituted with a member selected from the group consisting of a halogen atom, an alkyl group, an alkenyl group, an alkynyl group, an aryl group, a heterocyclic group, a heterocyclic group containing quaternized nitrogen atom, an acyl group, an alkoxycarbonyl group, an aryloxycarbonyl group, a carbamoyl group, a carboxy group or salt thereof, a sufonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group, an aryloxy group, a heterocyclic oxy group, an acyloxy group, an amino group, an N-substituted nitrogenous heterocylic group, an acylamino group, a sulfonamide group, a ureido group, a thioureido group, an imide group, a carbonylamino group, a sulfamoylamino group, a semicarbazido group, a thiosemicarbazido group, a hydrazino group, a quaternary amonio group, an oxamoylamino group, a sulfonylureido group, an acylureido group, an acylsulfamoylamino group, a nitro group, a mercapto group, a thio group, a suifonyl group, a sulfinyl group, a sulfo group or salt thereof, a sulfamoyl group, an acylsulfamoyl group, a sulfonylsulfamoyl group or a salt thereof, a group containing a phosphoramide or phosphate structure, a silyl group and a stannyl group.

13. The photothermographic material of claim 1 wherein $X_1$ and $X_2$ are selected from the group consisting of methoxy, ethoxy, propoxy, isopropoxy, octyloxy, decycloxy, dodecyloxy, cetyloxy, butoxy, t-butoxy, phenoxy, p-t-octylphenoxy, benztriazoloyl-5-oxy, pyridinyl-3-oxy, methylthio, ethylthio, butylthio, dodecylthio, phenylthio, p-dodecylphenylthio, 1-phenyltetrazoyl-5-thio, mercaptothia-diazolylthio, acetamido, octanoylamino, benzoylamino, trifluoroacetylamino, methanesulfonamide, benzenesulfon-amide, and dodecylsulfonamide.

14. The photothermographic material of claim 1 wherein $Z_2$ is a part of an aromatic or non-aromatic carbocycle or an aromatic or non-aromatic heterocycle, and forms a fused ring structure to the 5- to 7-membered cycle that $Z_2$ forms with $—Y_2—C(=CH—X_2)—C(Y_3)=N—$.

15. The photothermographic material of claim 1 wherein $Z_1$ is a part of an aromatic or non-aromatic carbocycle or an aromatic or non-aromatic heterocycle, and forms a fused ring structure to the 5- to 7-membered cycle that $Z_1$ forms with $—Y_1—C(=CH—X_1)—C(=O)—$.

16. The photothermographic material of claim 1 wherein the compounds of formula (A) have up to 40 carbon atoms.

17. The photothermographic material of claim 1 wherein the compounds of formula (A) have up to 30 carbon atoms.

18. The photothermographic material of claim 1 wherein the compounds of formula (B) have up to 40 carbon atoms.

19. The photothermographic material of claim 1 wherein the compounds of formula (B) have up to 32 carbon atoms.

* * * * *